US009535378B2

(12) United States Patent
Sakamaki et al.

(10) Patent No.: US 9,535,378 B2
(45) Date of Patent: Jan. 3, 2017

(54) FIXING DEVICE AND IMAGE FORMING APPARATUS

(71) Applicants: Takashi Sakamaki, Kanagawa (JP); Yohhei Watanabe, Kanagawa (JP); Naoto Suzuki, Kanagawa (JP); Masateru Ujiie, Kanagawa (JP)

(72) Inventors: Takashi Sakamaki, Kanagawa (JP); Yohhei Watanabe, Kanagawa (JP); Naoto Suzuki, Kanagawa (JP); Masateru Ujiie, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/696,906

(22) Filed: Apr. 27, 2015

(65) Prior Publication Data

US 2015/0323892 A1 Nov. 12, 2015

(30) Foreign Application Priority Data

May 9, 2014 (JP) ..... 2014-098168
Oct. 8, 2014 (JP) ..... 2014-207132
Oct. 31, 2014 (JP) ..... 2014-222801

(51) Int. Cl.
*G03G 15/20* (2006.01)

(52) U.S. Cl.
CPC ..... *G03G 15/20* (2013.01); *G03G 15/2053* (2013.01)

(58) Field of Classification Search
CPC ..... G03G 15/2053; G03G 15/2025; G03G 15/2075
USPC ..... 399/329, 327, 320
See application file for complete search history.

(56) References Cited

U.S. PATENT DOCUMENTS

2002/0168203 A1* 11/2002 Sasaki ..... B41J 13/226 399/344
2004/0131403 A1* 7/2004 Nakamura ..... G03G 8/00 399/341
2010/0316397 A1 12/2010 Kudou et al.
2013/0058672 A1* 3/2013 Takada ..... G03G 15/2025 399/67

(Continued)

FOREIGN PATENT DOCUMENTS

JP 2004-286922 10/2004
JP 2006-259341 9/2006

(Continued)

*Primary Examiner* — Walter L Lindsay, Jr.
*Assistant Examiner* — Jessica L Eley
(74) *Attorney, Agent, or Firm* — Harness, Dickey & Pierce, P.L.C.

(57) ABSTRACT

A fixing device includes a first rotator rotatable in a given direction of rotation and a second rotator contacting the first rotator to form a fixing nip therebetween through which a recording medium bearing a toner image is conveyed. A heater is disposed opposite and heats at least one of the first rotator and the second rotator. An abutment separably contacts the first rotator to refresh an outer circumferential surface of the first rotator. A mover is connected to the abutment to move the abutment with respect to the first rotator. A degradation estimator is operatively connected to the mover to estimate a degradation level of the outer circumferential surface of the first rotator and control the mover to move the abutment with respect to the first rotator according to the degradation level of the first rotator.

19 Claims, 11 Drawing Sheets

(56) References Cited

U.S. PATENT DOCUMENTS

| | | | | |
|---|---|---|---|---|
| 2013/0129364 | A1* | 5/2013 | Kitagawa ..... | G03G 15/2025 399/21 |
| 2014/0212188 | A1 | 7/2014 | Watanabe | |
| 2014/0294456 | A1 | 10/2014 | Ueno et al. | |

FOREIGN PATENT DOCUMENTS

| | | |
|---|---|---|
| JP | 2007-010869 | 1/2007 |
| JP | 2009-145376 | 7/2009 |
| JP | 2011-064740 | 3/2011 |
| JP | 2011-175067 | 9/2011 |
| JP | 2013-015658 | 1/2013 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2014-098168, filed on May 9, 2014, 2014-207132, filed on Oct. 8, 2014, and 2014-222801, filed on Oct. 31, 2014, in the Japanese Patent Office, the entire disclosure of each of which is hereby incorporated by reference herein.

BACKGROUND

Technical Field

Example embodiments generally relate to a fixing device and an image forming apparatus, and more particularly, to a fixing device for fixing a toner image on a recording medium and an image forming apparatus incorporating the fixing device.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a first rotator, such as a fixing roller, a fixing belt, and a fixing film, heated by a heater and a second rotator, such as a pressure roller and a pressure belt, pressed against the first rotator to form a fixing nip therebetween through which a recording medium bearing a toner image is conveyed. As the recording medium bearing the toner image is conveyed through the fixing nip, the first rotator and the second rotator apply heat and pressure to the recording medium, melting and fixing the toner image on the recording medium.

SUMMARY

At least one embodiment provides a novel fixing device that includes a first rotator rotatable in a given direction of rotation and a second rotator contacting the first rotator to form a fixing nip therebetween through which a recording medium bearing a toner image is conveyed. A heater is disposed opposite and heats at least one of the first rotator and the second rotator. An abutment separably contacts the first rotator to refresh an outer circumferential surface of the first rotator. A mover is connected to the abutment to move the abutment with respect to the first rotator. A degradation estimator is operatively connected to the mover to estimate a degradation level of the outer circumferential surface of the first rotator and control the mover to move the abutment with respect to the first rotator according to the degradation level of the first rotator.

At least one embodiment provides a novel image forming apparatus that includes an image forming device to form a toner image on a recording medium and a fixing device, disposed downstream from the image forming device in a recording medium conveyance direction, to fix the toner image on the recording medium. The fixing device includes a first rotator rotatable in a given direction of rotation and a second rotator contacting the first rotator to form a fixing nip therebetween through which the recording medium bearing the toner image is conveyed. A heater is disposed opposite and heats at least one of the first rotator and the second rotator. An abutment separably contacts the first rotator to refresh an outer circumferential surface of the first rotator. A mover is connected to the abutment to move the abutment with respect to the first rotator. A degradation estimator is operatively connected to the mover to estimate a degradation level of the outer circumferential surface of the first rotator and control the mover to move the abutment with respect to the first rotator according to the degradation level of the first rotator.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
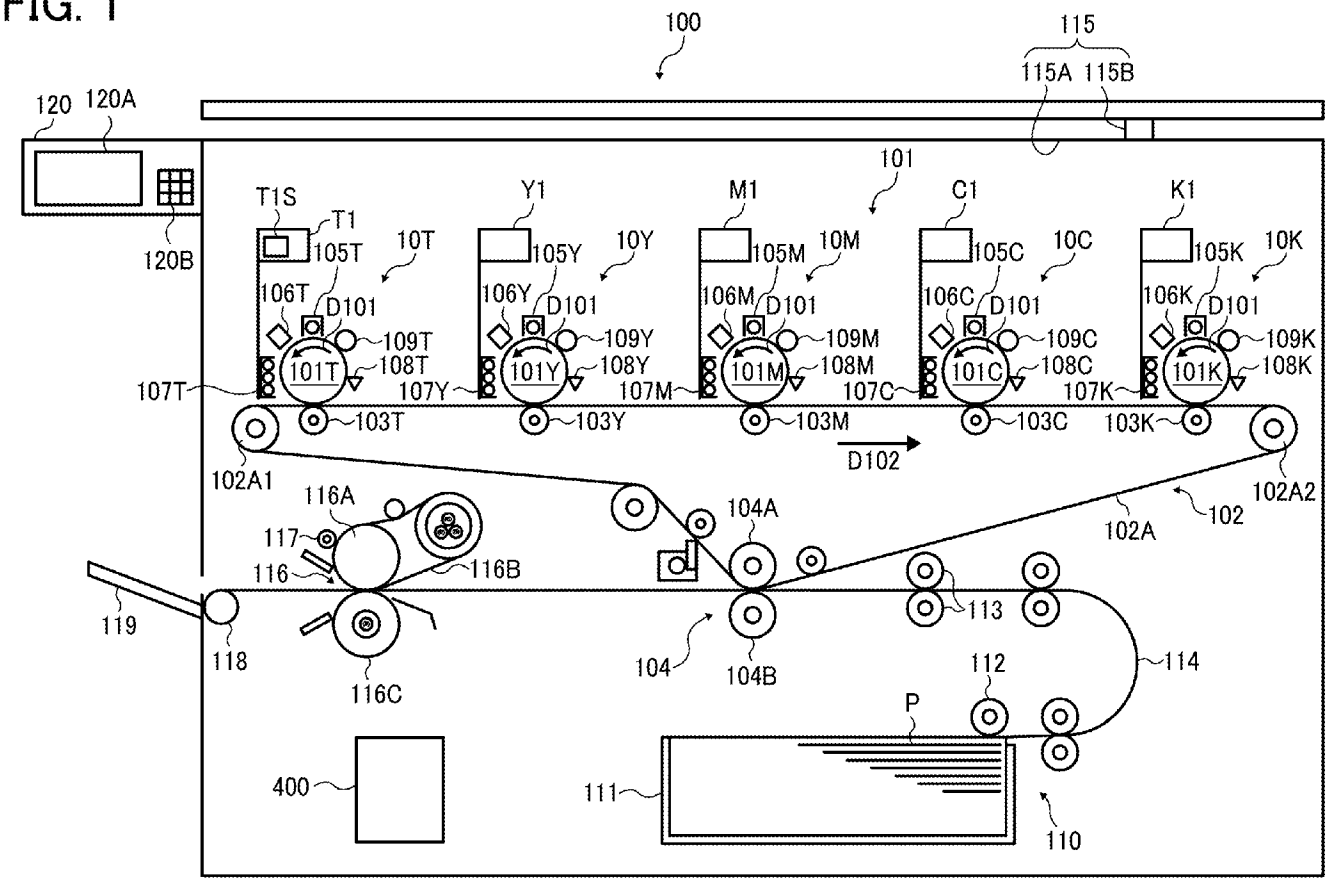
FIG. 1 is a schematic vertical sectional view of an image forming apparatus according to an example embodiment of the present disclosure.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present disclosure.

The terminology used herein is for the purpose of describing particular embodiments only and is not intended to be limiting of the present disclosure. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

The image forming apparatus 100 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 100 is a copier that forms color and monochrome toner images on recording media by electrophotography.

With reference to FIG. 1, a description is provided of a construction of the image forming apparatus 100.

FIG. 1 is a schematic vertical sectional view of the image forming apparatus 100. The image forming apparatus 100 includes an image forming device 101 and an intermediate transfer device 102 situated below the image forming device 101. The image forming device 101 includes a plurality of image forming stations 10T, 10Y, 10M, 10C, and 10K including a plurality of photoconductive drums 101T, 101Y, 101M, 101C, and 101K, respectively, which is aligned along a stretched face of a transfer belt 102A of the intermediate transfer device 102 in a rotation direction D102. Suffixes T, Y, M, C, and K denote transparent, yellow, magenta, cyan, and black, respectively. The five photoconductive drums 101T, 101Y, 101M, 101C, and 101K are accommodated in five units inside the image forming device 101, respectively.

Since the five units have an identical construction, a description is provided of the construction of the unit accommodating the photoconductive drum 101T that forms a clear toner image, that is, a transparent toner image.

The photoconductive drum 101T is rotatable in a rotation direction D101 and surrounded by a charger 105T, a writer 106T, a developing device 107T, a discharger 108T, and a cleaner 109T in this order in the rotation direction D101 of the photoconductive drum 101T to form the clear toner image on the photoconductive drum 101T. Similarly, the photoconductive drums 101Y, 101M, 101C, and 101K are rotatable in the rotation direction D101 and surrounded by chargers 105Y, 105M, 105C, and 105K, writers 106Y, 106M, 106C, and 106K, developing devices 107Y, 107M, 107C, and 107K, dischargers 108Y, 108M, 108C, and 108K, and cleaners 109Y, 109M, 109C, and 109K in this order in the rotation direction D101 of the photoconductive drums 101Y, 101M, 101C, and 101K to form yellow, magenta, cyan, and black toner images on the photoconductive drums 101Y, 101M, 101C, and 101K, respectively.

The clear toner image having passing under the developing device 107T comes into contact with the transfer belt 102A stretched taut across five primary transfer rollers 103T, 103Y, 103M, 103C, and 103K, a plurality of support rollers 102A1 and 102A2, and a secondary transfer roller 104A. In proximity to the intermediate transfer device 102 is a secondary transfer device 104 incorporating a backup roller 104B disposed opposite the secondary transfer roller 104A via the transfer belt 102A.

Below the image forming device 101 is a sheet feeder 110. The sheet feeder 110 includes a paper tray 111 that loads a plurality of sheets P serving as recording media, a feed roller 112 that picks up and feeds a sheet P from the paper tray 111, a registration roller pair 113, and a conveyance path 114 extending from the feed roller 112 to the registration roller pair 113. Although not indicated by a reference numeral, a plurality of conveyance rollers is located in the conveyance path 114.

Above the image forming device 101 is a scanner 115 including an exposure glass 115A disposed atop the image forming apparatus 100 and a reading element 115B. Downstream from the secondary transfer device 104 in a sheet conveyance direction is a fixing device 116. The sheet P ejected from the fixing device 116 is ejected onto an output tray 119 through an output roller 118. The fixing device 116 fixes the toner image secondarily transferred from the transfer belt 102A onto the sheet P thereon.

Figure 2:
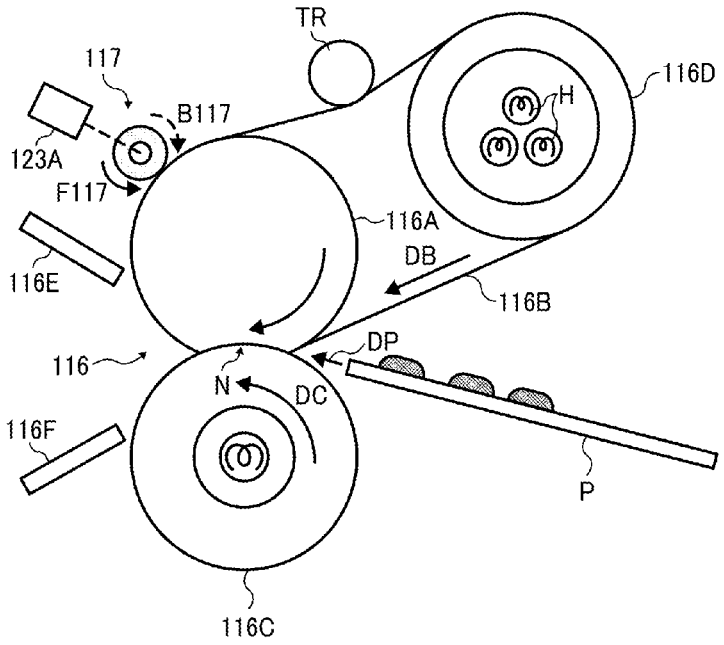
FIG. 2 is a schematic vertical sectional view of a fixing device incorporated in the image forming apparatus shown in FIG. 1.

With reference to FIG. 2, a description is provided of a construction of the fixing device 116.

FIG. 2 is a schematic vertical sectional view of the fixing device 116. As shown in FIG. 2, the fixing device 116 (e.g., a fuser or a fusing unit) employs a belt fixing method. The fixing device 116 includes a fixing roller 116A and a fixing belt 116B, one of which serves as a first rotator, and a pressure roller 116C serving as a second rotator. The fixing roller 116A and the fixing belt 116B face a conveyance path through which the sheet P is conveyed. The pressure roller 116C is disposed opposite the first rotator via the conveyance path. According to this example embodiment, the fixing belt 116B is used as the first rotator.

A detailed description is now given of a construction of the fixing belt 116B.

The fixing belt 116B is a multi-layer endless belt constructed of a base layer, an elastic layer coating the base layer, and a release layer coating the elastic layer. The base layer, having a layer thickness of about 90 micrometers, is made of polyimide (PI) resin. The elastic layer is made of silicone rubber or the like. The elastic layer, having a layer thickness of about 200 micrometers, is made of an elastic material such as silicone rubber, fluoro rubber, silicone rubber foam, and the like. The release layer, having a layer thickness of about 20 micrometers, is made of tetrafluoroethylene-perfluoroalkylvinylether copolymer (PFA), polyimide (PI), polyether imide (PEI), polyether sulfide (PES), or the like. The release layer serving as an outer layer of the fixing belt 116B facilitates separation of toner of the toner image from the fixing belt 116B.

The fixing belt 116B and the pressure roller 116C, as they contact each other while rotating in rotation directions DB and DC, respectively, form a fixing nip N therebetween. The fixing belt 116B is looped over the fixing roller 116A and a heating roller 116D serving as a heating rotator accommodating a heater H. As the fixing belt 116B rotates in the rotation direction DB, the fixing belt 116B heats the fixing nip N which in turn heats the sheet P to a fixing temperature. As the sheet P bearing the toner image is conveyed through the fixing nip N formed between the fixing belt 116B and the pressure roller 116C, the fixing belt 116B and the pressure roller 116C apply heat and pressure to the sheet P. Accordingly, toner of the toner image melts and permeates the sheet P. Thus, the toner image is fixed on the sheet P. The fixing device 116 further includes a plurality of separators 116E and 116F that separates the sheet P ejected from the fixing nip N from an outer circumferential surface of the fixing belt 116B and the pressure roller 116C, respectively. A tension roller TR places tension to the fixing belt 116B.

The fixing device 116 further includes an abutment 117 that contacts the outer circumferential surface of the fixing belt 116B to smooth and refresh the outer circumferential surface of the fixing belt 116B. The abutment 117 is disposed opposite the fixing roller 116A via the fixing belt 116B and slidable over the outer circumferential surface of the fixing belt 116B. A mover 123A connected to the abutment 117 brings the abutment 117 into contact with and separation from the fixing belt 116B. The abutment 117 is a roller having a length corresponding to a width of a maximum sheet P, that is, an increased width of the recording medium, available in the image forming apparatus 100 in an axial direction of the abutment 117. The abutment 117 is rotatable independently from the fixing belt 116B.

Figure 3:
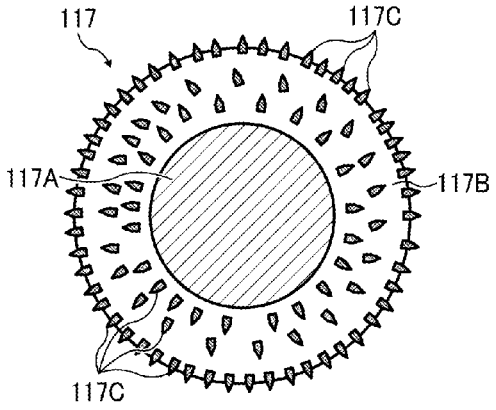
FIG. 3 is a front view of an abutment incorporated in the fixing device shown in FIG. 2.

FIG. 3 is a front view of the abutment 117. As shown in FIG. 3, the abutment 117 includes a roller rotatable while contacting the outer circumferential surface of the fixing belt 116B. The abutment 117 mounts lots of fine abrasive grains scattered on a surface of the abutment 117. For example, the abutment 117 includes a cored bar 117A, a binder layer 117B coating the cored bar 117A and made of silicone rubber, fluoroplastic, or the like, and abrasive grains 117C scattered on the binder layer 117B. The abrasive grains 117C are made of white alumina, brown alumina, pulverized alumina, rose-pink alumina, black silicon carbide, diamond, cubic boron nitride (CBN), or the like. The grit size of the abrasive grains 117C is #1500, for example, and determined based on the material of the fixing belt 116B, the sliding condition under which the abutment 117 slides over the fixing belt 116B, or the like. The grit size of the abrasive grains 117C is selected to prevent faulty streaks or decreased gloss that may appear on the toner image if the abrasive grains 117C roughen the outer circumferential surface of the fixing belt 116B excessively. Conversely, if the abrasive grains 117C roughen the outer circumferential surface of the fixing belt 116B insufficiently, solid substances may not be removed from the fixing belt 116B uniformly or the fixing belt 116B may suffer from local plastic deformation. To address this circumstance, the grit size of the abrasive grains 117C may be in a range of from about #600 to about #3000.

The abutment 117 serves as a grinder separably contacting the outer circumferential surface of the fixing belt 116B. Accordingly, the abutment 117 is disposed opposite the fixing roller 116A serving as a backup roller when the abutment 117 grinds the fixing belt 116B or removes toner particles and an additive contained in toner from the fixing belt 116B. Alternatively, the abutment 117 may attain a given surface roughness by sand blasting or the like instead of scattering with the abrasive grains 117C.

A description is provided of a configuration of the mover 123A.

Figure 4:
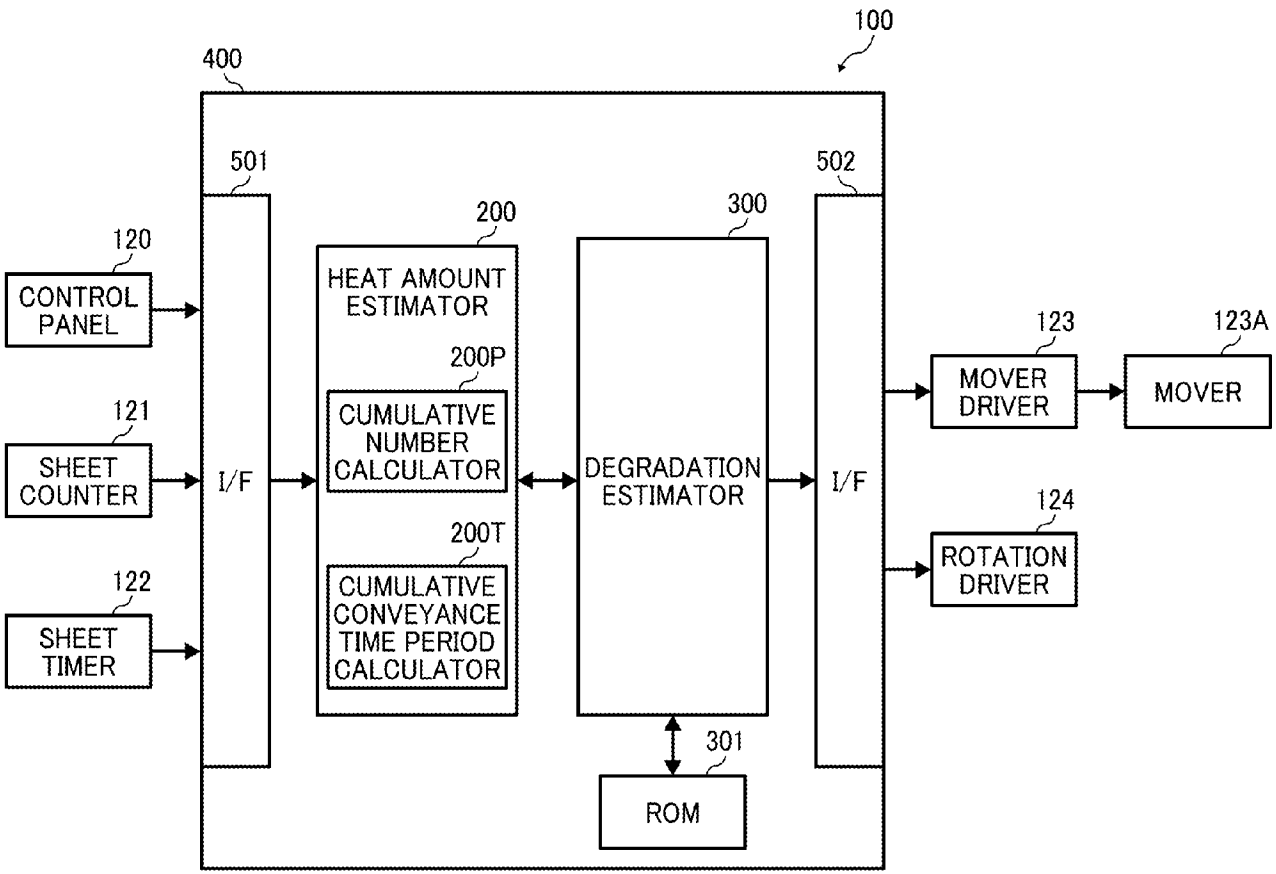
FIG. 4 is a block diagram of the image forming apparatus shown in FIG. 1.

FIG. 4 is a block diagram of the image forming apparatus 100. The mover 123A that brings the abutment 117 into contact with and separation from the fixing belt 116B brings the abutment 117 into contact with the fixing belt 116B according to the degradation level of the fixing belt 116B determined by a heat amount estimator 200 and a degradation estimator 300.

A controller 400 (e.g., a processor) shown in FIGS. 1 and 4 controls the mover 123A. The controller 400 may be exclusively used to control the mover 123A. However, the controller 400 shown in FIG. 4 that is used for image forming sequence control of the image forming apparatus 100 supports control of the mover 123A. As shown in FIG. 4, according to this example embodiment, a control panel 120, a sheet counter 121, and a sheet timer 122 are operatively connected to an input side of the controller 400 through an interface (I/F) 501. A mover driver 123 and a rotation driver 124 are operatively connected to an output side of the controller 400 through an interface (I/F) 502.

A detailed description is now given of a configuration of the control panel 120.

As shown in FIG. 1, the control panel 120 includes a liquid crystal panel 120A and keys 120B. A user specifies a print mode, the number of sheets P to be printed, the type of the sheet P, and the thickness of the sheet P. The print mode, that is, an image forming mode, specifies the size and the orientation of the sheet P. The image forming apparatus 100 provides at least three print modes, that is, a monochrome image forming mode, a full-color image forming mode that forms a toner image with toners in four colors (e.g., yellow, magenta, cyan, and black toners), and a five-color image forming mode, as a special color image forming mode, that forms a toner image with a special color toner (e.g., a white or clear toner) in addition to the toners in four colors. The user selects one of the three print modes through the control panel 120. As the user inputs the print mode, the print rate calculated based on information from the reading element 115B is input to the controller 400 which determines an amount of toner to be used to form a toner image on the sheet P. The print rate defines an image area rate relative to the size of the sheet P. The image area rate is identical regardless of the orientation of the sheet P relative to a sheet conveyance direction DP of the sheet P shown in FIG. 2. Accordingly, the orientation of the sheet P relative to the sheet conveyance direction DP is specified in advance to address a situation in which the amount of heat conducted to the sheet P varies depending on a conveyance time period of the sheet P conveyed through the fixing nip N even if the image area rate is identical.

A detailed description is now given of a configuration of the mover driver 123 and the rotation driver 124 depicted in FIG. 4.

The mover driver 123 connected to the output side of the controller 400 drives the mover 123A that moves the abutment 117 with respect to the fixing belt 116B. The rotation driver 124 sets the rotation speed and the rotation direction of the abutment 117 and drives the abutment 117.

A detailed description is now given of a configuration of the heat amount estimator 200.

The heat amount estimator 200 estimates an estimated amount of heat used to fix the toner image on the sheet P (hereinafter referred to as the estimated amount of heat), which is calculated based on the type of toner contacting the fixing belt 116B, the thickness of the sheet P, and the print rate on the sheet P by using the number of sheets P conveyed through the fixing nip N and the conveyance time period of at least one sheet P conveyed through the fixing nip N (hereinafter referred to as the number of sheets P and the conveyance time period of the sheet P) as parameters. The estimated amount of heat estimated by the heat amount estimator 200 is used to presume an amount of the toner particles and the additive contained in the toner to be adhered to the fixing belt 116B. The estimated amount of heat estimated by the heat amount estimator 200 is sent to the degradation estimator 300 as data.

A description is provided of a configuration of a comparative fixing device incorporating a fixing belt like the fixing belt 116B depicted in FIG. 2.

The comparative fixing device includes a fixing belt, a pressure roller, a roller over which the fixing belt is looped, and a heater disposed opposite the fixing belt.

After a substantial number of sheets is conveyed through the comparative fixing device, paper dust generated from burrs on each lateral edge of the sheet in a width direction thereof and a separation claw pressed against an outer circumferential surface of the fixing belt to separate the sheet therefrom may produce fine scratches, projections, and depressions on the outer circumferential surface of the fixing belt. As the sheet bearing the toner image is conveyed over a damaged portion of the fixing belt produced with the scratches, the projections, and the depressions, the damaged portion of the fixing belt may apply a gloss to the toner image fixed on the sheet that is different from a gloss applied by other non-damaged portion of the fixing belt, thus producing variation in gloss of the toner image fixed on the sheet. Variation in gloss of the toner image is not conspicuous if the toner image is line drawing, however, is conspicuous if the toner image is a solid image such as a photographic image.

To address this circumstance, the comparative fixing device may include a mechanism to grind and refresh the fixing belt. For example, a frictional member containing abrasive grains contacts and grinds the outer circumferential surface of the fixing belt rotating in a given rotation direction. Thus, the frictional member smoothes the outer circumferential surface of the fixing belt, eliminating variation in gloss of the toner image fixed on the sheet.

An image forming apparatus may form a full-color toner image and a toner image having varied glossiness throughout the entire toner image or a part of the toner image in addition to a monochrome toner image. Accordingly, the image forming apparatus uses, in addition to the four toners, that is, the yellow, magenta, cyan, and black toners as complementary colors of red, green, and blue, the white toner and the clear toner as a fifth toner to form a spot toner image by changing the glossiness of the toner image entirely or partially.

The white toner and the clear toner (e.g., a transparent toner) are special color toners that are mounted on the full-color toner image to enhance the glossiness of the full-color toner image or form a toner image different from the full-color toner image and the yellow, magenta, cyan, and black toner images. Those toners including the yellow, magenta, cyan, black, white, and clear toners contain an additive such as wax to prevent offset of the toners to the fixing belt and adhesion between toner particles under heat during a fixing job. As the number of sheets conveyed through the comparative fixing device increases, an amount of the toner particles and the additive such as the wax contained in the toner that may adhere to the fixing belt increases, degrading the smoothness of the outer circumferential surface of the fixing belt and varying the glossiness of the toner image fixed on the sheet.

To address this circumstance, the frictional member may grind and refresh the outer circumferential surface of the fixing belt to recover the smoothness of the outer circumferential surface of the fixing belt, thus refreshing the fixing belt. However, if a grinding face of the frictional member is embedded with the toner particles and the additive, the frictional member may grind the fixing belt insufficiently and therefore a wiper separately provided from the frictional member may wipe the fixing belt to remove the toner particles and the additive thereof. For example, since removal of the toner particles and the additive from the fixing belt is possible with decreased pressure compared to grinding of the fixing belt that requires increased pressure, the wiper wipes the fixing belt with decreased pressure exerted to the outer circumferential surface of the fixing belt.

However, the frictional member and the wiper may complicate a configuration and a control of the comparative fixing device. For example, a time period for which the frictional member contacts the fixing belt to grind and refresh the fixing belt is determined based on the temperature of the outer circumferential surface of the fixing belt. Alternatively, the time period for which the frictional member contacts the fixing belt may be increased according to a time period required to recover the smoothness of the fixing belt, suppressing degradation in grinding the outer circumferential surface of the fixing belt.

The control applied to grinding of the fixing belt is not applicable to wiping of the fixing belt. For example, since grinding is different from wiping, if the control applied to grinding is applied to wiping, the frictional member may adversely roughen the outer circumferential surface of the fixing belt. Accordingly, after removal of the toner particles and the additive, the fixing belt may suffer from degradation in surface asperities, varying the glossiness of the toner image contacted by the degraded fixing belt.

A description is provided of disadvantages that may arise as the fixing belt 116B is adhered with the toner particles and the additive.

The toner particles and the additive adhered to the fixing belt 116B, when they stick to the fixing belt 116B, may degrade the surface smoothness of the fixing belt 116B and the glossiness of the toner image fixed on the sheet P. To address this circumstance, the degradation estimator 300 receives the estimated amount of heat from the heat amount estimator 200 to estimate the degradation level of the outer circumferential surface of the fixing belt 116B based on the parameters described above. Based on the estimated degradation level of the fixing belt 116B, the degradation estimator 300 calculates a grinding condition under which the abutment 117 grinds the fixing belt 116B and a removal condition under which the abutment 117 removes the toner particles and the additive from the fixing belt 116B. The degradation estimator 300 controls the mover driver 123 to move the mover 123A to bring the abutment 117 into contact with and separation from the fixing belt 116B under the grinding condition and the removal condition.

The toner to come into contact with the abutment 117 described above defines an uppermost toner among toners layered on the outer circumferential surface of the fixing belt 116B. When the uppermost toner contacts the abutment 117, the uppermost toner among the yellow, magenta, cyan, and black toners layered on the fixing belt 116B may contact the sheet P. Alternatively, the clear toner layered on the yellow, magenta, cyan, and black toners or the clear toner layered on one of the yellow, magenta, cyan, and black toners may contact the fixing belt 116B as the uppermost toner. A toner image produced by layering the clear toner on a monochrome toner (e.g., one of the yellow, magenta, cyan, and black toners) is used as one embodiment of a spot color toner image.

The toner contacting the abutment 117 is determined based on selection among the full-color image forming mode, the monochrome image forming mode, and the special color image forming mode using the clear toner or the like other than toner used in the monochrome image forming mode and the full-color image forming mode.

The amount of adhesion of the toner particles and the additive is determined based on the number of sheets P to be conveyed through the fixing nip N and the conveyance time period of the sheet P. However, an adhesion state is affected substantially by the amount of heat used to fix the toner image on the sheet P. To address this circumstance, the controller 400 determines the adhesion state in detail based on the parameters described above in addition to the number of sheets P and the conveyance time period of the sheet P.

The heat amount estimator 200, based on the print mode defining the type of toner used, the type of the sheet P, and the thickness of the sheet P, estimates the amount of heat that may require refreshment of the outer circumferential surface of the fixing belt 116B according to a formula (1) below through a weighting process to obtain the estimated amount of heat.

$$h1=a\times n1+b\times n2 \quad (1)$$

In the formula (1), h1 represents the estimated amount of heat. a represents a weighting coefficient. b represents a weighting coefficient. n1 represents the number of sheets P conveyed through the fixing nip N in the full-color image forming mode. n2 represents the number of sheets P conveyed through the fixing nip N in the five-color image forming mode using the special color toner. The full-color image forming mode forms a full-color toner image with the yellow, magenta, cyan, and black toners. The five-color image forming mode using the clear toner defines the special color image forming mode that forms a glossy full-color toner image by layering the special color toner on the uppermost toner layer of a full-color toner image to adjust the glossiness of the glossy full-color toner image.

The weighting coefficient a (e.g., a=1.0) is greater than the weighting coefficient b (e.g., b=0.2) due to the reasons described below.

The special color image forming mode using the special color toner other than the yellow, magenta, cyan, and black toners, such as the clear toner and the white toner, forms a toner image produced with an increased total amount of toner. Accordingly, in order to conduct the amount of heat needed to fix the toner image on the sheet P to the sheet P, the sheet P is conveyed through the fixing nip N at a decreased conveyance speed, that is, a decreased process linear velocity, lower than an conveyance speed at which the sheet P is conveyed in the full-color image forming mode. Thus, the toner image is formed on the sheet P for an increased image formation processing time.

As the process linear velocity decreases, the fixing temperature at which the toner image is fixed on the sheet P decreases. As the fixing temperature decreases, the additive such as wax effuses in a decreased amount. Accordingly, the additive adheres to the fixing belt 116B at a decreased rate. Consequently, the weighting coefficient b applied to the five-color image forming mode using the special color toner other than the yellow, magenta, cyan, and black toners is smaller than the weighting coefficient a applied to the full-color image forming mode.

The special color toner such as the white toner and the clear toner may have a property different from that of the yellow, magenta, cyan, and black toners used to form the full-color toner image. For example, if the special color toner layered on the uppermost toner layer among yellow, magenta, cyan, and black toner layers in the five-color image forming mode contacts the fixing belt 116B serving as the first rotator, the special color toner may adhere to the fixing belt 116B with a decreased adhesion rate due to its property compared to the yellow, magenta, cyan, and black toners used to form the full-color toner image. Accordingly, the weighting coefficient b applied to the five-color image forming mode, that is, the special color image forming mode, using the special color toner other than the yellow, magenta, cyan, and black toners is smaller than the weighting coefficient a applied to the full-color image forming mode.

The heat amount estimator 200 may not precisely determine the estimated amount of heat that should be estimated according to the amount of toner used to form the toner image based on the number of sheets P conveyed through the fixing nip N only as defined by the formula (1). For example, since the sheets P having the identical size may be conveyed at different process linear velocities according to the type of toner and the print rate, heat in different amounts may be conducted to the sheets P, respectively.

To address this circumstance, the heat amount estimator 200 may calculate the estimated amount of heat by estimating the amount of heat conducted to the fixing belt 116B based on the conveyance time period of the sheet P as defined by a formula (2) below, not based on the number of sheets P conveyed through the fixing nip N.

As described above, the conveyance time period of the sheet P is determined by considering the difference in the process linear velocity and the fixing temperature between the full-color image forming mode and the special color image forming mode using the special color toner such as the white toner and the clear toner in addition to the yellow, magenta, cyan, and black toners used to form the full-color toner image.

$$h2=c\times t1+d\times t2 \quad (2)$$

In the formula (2), h2 represents the estimated amount of heat. c represents a weighting coefficient. d represents a weighting coefficient. t1 represents the conveyance time period of the sheet P conveyed through the fixing nip N in the full-color image forming mode. t2 represents the conveyance time period of the sheet P conveyed through the fixing nip N in the five-color image forming mode using the special color toner. In the formula (2) also, the controller 400 performs the weighting process to calculate the estimated amount of heat according to the print mode.

The weighting coefficient c (e.g., c=1.0) is greater than the weighting coefficient d (e.g., d=0.2) due to the reasons described below. As described above, when using the clear toner, the sheet P is conveyed through the fixing nip N at a decreased conveyance speed, that is, a decreased process linear velocity, lower than an increased conveyance speed at which the sheet P is conveyed in the full-color image forming mode. Additionally, the fixing temperature at which the toner image is fixed on the sheet P decreases and therefore the amount of heat conducted to the sheet P decreases compared to that in the full-color image firming mode.

Further, as described above, the controller 400 calculates the conveyance time period of the sheet P to calculate the amount of heat conducted to the sheet P according to an actual conveyance state of the sheet P to address a circumstance in which a time taken to conduct heat to the sheet P varies depending on the orientation of the sheet P relative to the sheet conveyance direction DP even under the identical image area rate.

The weighting coefficients a to d are determined by considering the type and the thickness of the sheet P specified on the control panel 120 in addition to the print mode such as the full-color image forming mode and the five-color image forming mode (e.g., the special color image forming mode using the clear toner).

The type of the sheet P includes plain paper, coated paper, and non-coated paper. The type of the sheet P defines a surface state of the sheet P. For example, the coated paper has a surface smoothness greater than that of the plain paper to attain an increased glossiness. For example, the coated paper is coated with white pigment or the like. The non-coated paper includes Kent paper having a glossiness smaller than that of the coated paper. It is to be noted that the type of the sheet P and the thickness of the sheet P may be hereinafter referred to as the sheet type and the sheet thickness, respectively.

The sheet type may affect an adhesion state of toner to the sheet P that varies depending on the surface smoothness of the sheet P. The sheet thickness may affect the amount of heat conducted to the sheet P.

Considering the factors described above, the controller 400 changes the weighting coefficients a to d when calculating the amount of heat conducted to the sheet P according to the adhesion state of at least one of the toner particles and the additive to the sheet P.

Figure 5:
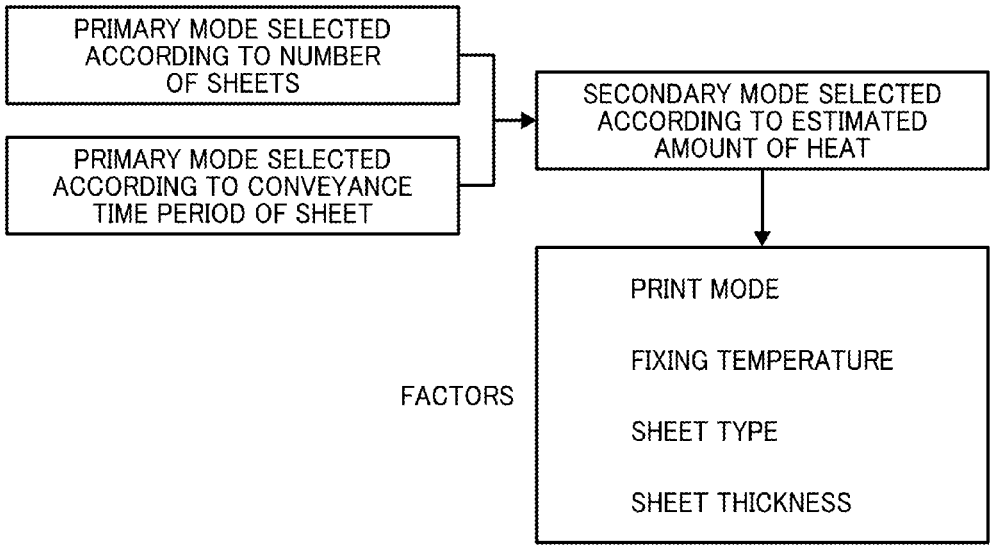
FIG. 5 is a diagram showing a relation between parameters used by a controller incorporated in the image forming apparatus shown in FIG. 4 and actuation modes of the abutment shown in FIG. 3.

FIG. 5 is a diagram showing a relation between parameters used by the controller 400 and actuation modes of the abutment 117. FIG. 5 lists a plurality of factors including the type of the sheet P used to control the mover driver 123 depicted in FIG. 4 that drives the mover 123A to move the abutment 117 with respect to the fixing belt 116B. As shown in FIG. 5, the factors including the print mode, the fixing temperature, the sheet type, and the sheet thickness determine the weighting coefficients a to d used in the formulas (1) and (2) to calculate the amount of heat conducted to the fixing belt 116B. The print mode defines the color of toner used in a print job to form a toner image on a sheet P and the print rate. The fixing temperature varies depending on the process linear velocity that varies depending on the print mode. The sheet type includes the plain paper, the coated paper, the non-coated paper, and the brand.

Table 1 below shows the weighting coefficients determined based on the sheet type and the sheet thickness, for example, the weighting coefficients a and b used in the formula (1).

TABLE 1

| | Plain paper | | Coated paper | |
|---|---|---|---|---|
| Sheet thickness | Standard velocity Weighting coefficient a | Decreased velocity Weighting coefficient b | Standard velocity Weighting coefficient a | Decreased velocity Weighting coefficient b |
| 1 (52.3 gsm to 63.0 gsm) | 0 | 0 | 0 | 0 |
| 2 (63.1 gsm to 80.0 gsm) | 0 | 0 | 0.5 | 0 |
| 3 (80.1 gsm to 105.0 gsm) | 0.5 | 0.1 | 0.7 | 0.1 |
| 4 (105.1 gsm to 163.0 gsm) | 0.5 | 0.1 | 0.7 | 0.1 |
| 5 (163.1 gsm to 220.0 gsm) | 1 | 0.2 | 1 | 0.2 |
| 6 (220.1 gsm to 256.0 gsm) | 1 | 0.2 | 1 | 0.2 |
| 7 (256.1 gsm to 300.0 gsm) | 1 | 0.2 | 1.3 | 0.3 |
| 8 (300.1 gsm to 350.0 gsm) | 1 | 0.2 | 1.3 | 0.3 |

The degradation estimator 300 compares the estimated amount of heat calculated by the heat amount estimator 200 with a preset threshold. The threshold is equivalent to an amount of heat conducted to the fixing belt 116B at a contact start time when the abutment 117 comes into contact with the fixing belt 116B. The threshold is stored in a read-only memory (ROM) 301 connected to the degradation estimator 300 as shown in FIG. 4.

The degradation estimator 300 controls the mover 123A based on at least one of the contact start time of the abutment 117 described above, a contact time period when the abutment 117 contacts the fixing belt 116B, a rotation direction of the abutment 117, and a difference in linear velocity between the abutment 117 and the fixing belt 116B. The degradation estimator 300 compares the estimated amount of heat sent from the heat amount estimator 200 with the threshold constantly as well as periodically with an arbitrary interval under a particular circumstance. For example, the particular circumstance is a case in which a condition that decreases the weighting coefficient continues, in other words, a case in which the print mode that decreases adhesion of the toner particles and the additive to the fixing belt 116B continues.

The degradation estimator 300 adjusts contact of the abutment 117 to the fixing belt 116B. For example, the degradation estimator 300 selectively performs a primary mode and a secondary mode. In the primary mode, the abutment 117 grinds the outer circumferential surface of the fixing belt 116B. In the secondary mode, the abutment 117 removes the toner particles and the additive from the fixing belt 116B. Hence, the degradation estimator 300 selects the primary mode according to the degradation level of the fixing belt 116B estimated based on the number of sheets P or the conveyance time period of the sheet P. The degradation estimator 300 selects the secondary mode according to the estimated amount of heat estimated by the heat amount estimator 200. In the primary mode, the abutment 117 grinds the outer circumferential surface of the fixing belt 116B. In the secondary mode, the abutment 117 removes at least one of the toner particles and the additive from the outer circumferential surface of the fixing belt 116B.

In each of the primary mode and the secondary mode selected, the degradation estimator 300 adjusts the contact start time, the contact time period, the rotation direction, and the rotation speed of the abutment 117 based on the degradation level of the fixing belt 116B estimated by the degradation estimator 300. In each of the primary mode and the secondary mode, the number of sheets P and the conveyance time period of the sheet P are used as the parameters. Accordingly, if the condition to perform the secondary mode is satisfied while the primary mode is performed, the secondary mode is performed successively after the primary mode.

If a situation implying that the condition to perform the secondary mode is satisfied occurs before the primary mode is performed due to output of an error signal or the like, the degradation estimator 300 may identify the error signal through an error check or the like. However, the degradation estimator 300 may perform an alternative process below. For example, the degradation estimator 300 performs the primary mode after the secondary mode and thereafter performs the secondary mode again, thus smoothing the outer circumferential surface of the fixing belt 116B roughened during the primary mode.

A description is provided of control of the mover 123A performed by the degradation estimator 300.

Figure 6A:
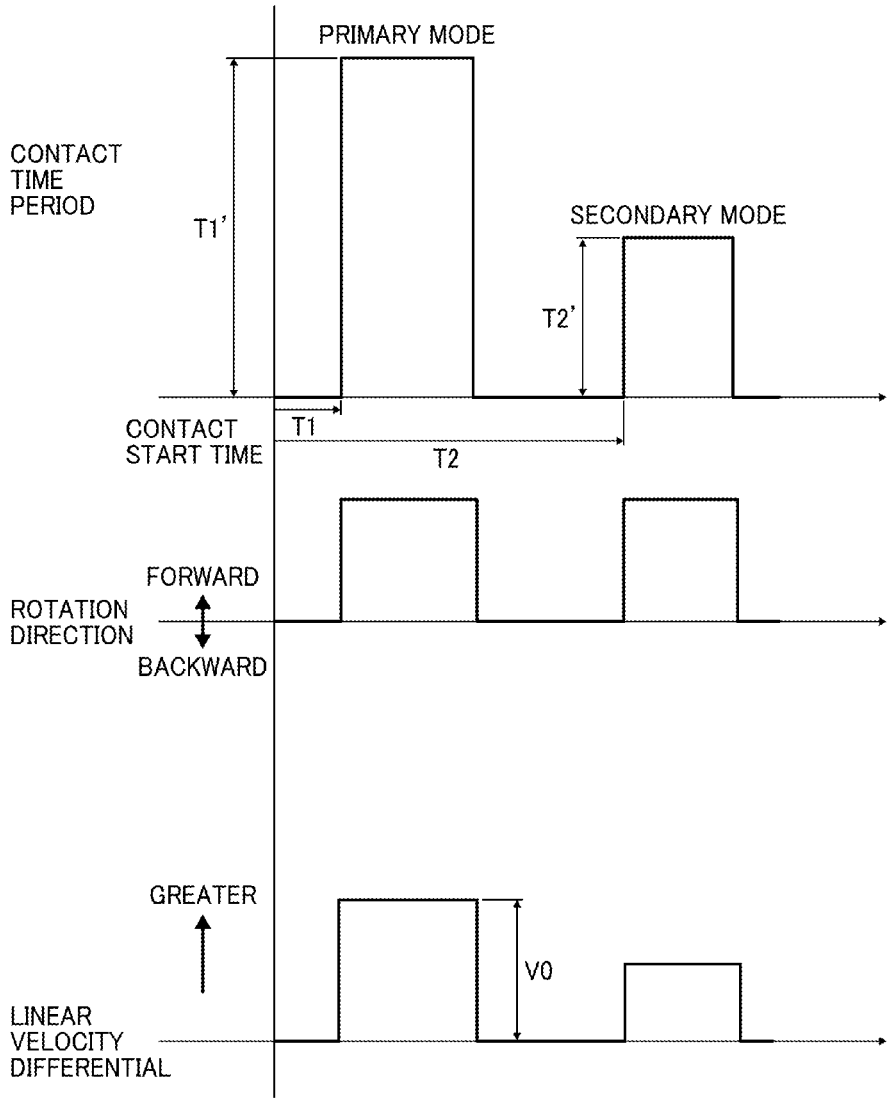
FIG. 6A is a timing chart showing control of a mover incorporated in the fixing device shown in FIG. 2 when the abutment shown in FIG. 3 rotates forward.
Figure 6B:
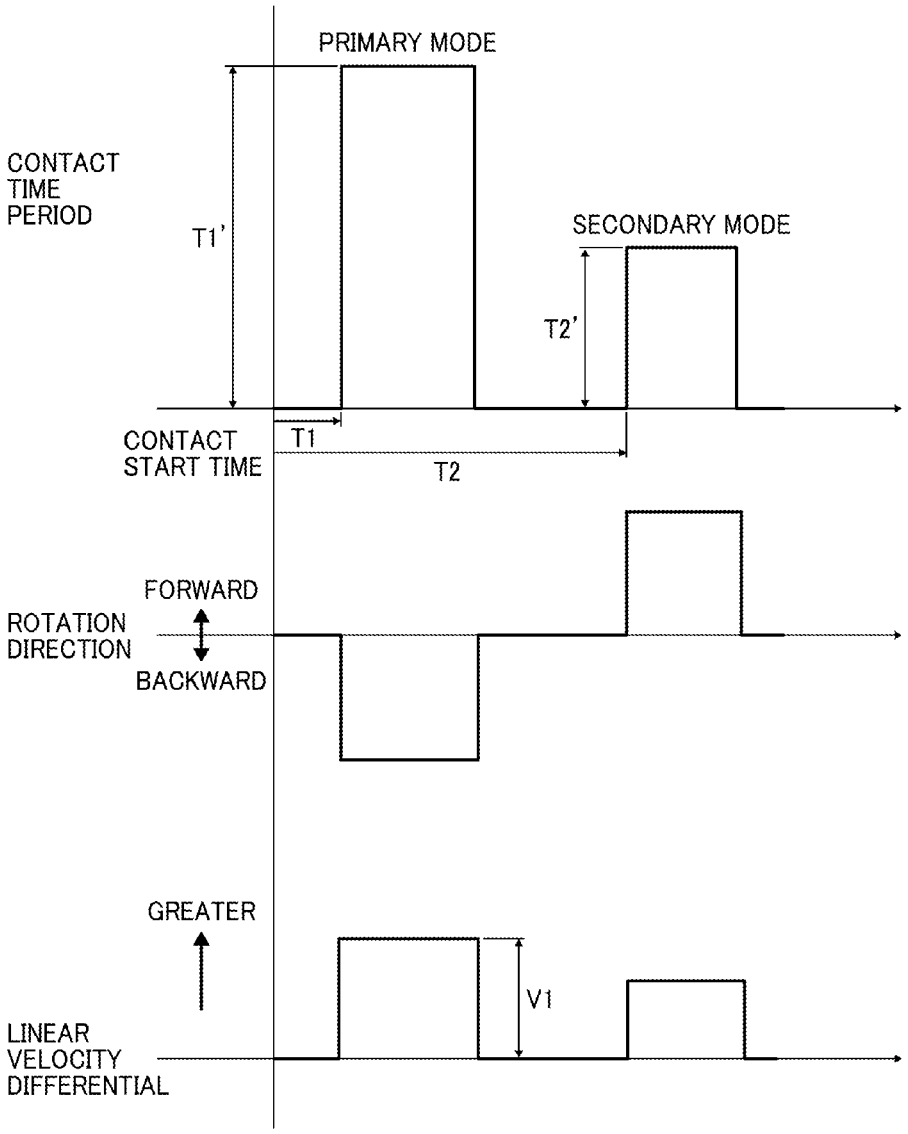
FIG. 6B is a timing chart showing control of the mover when the abutment rotates backward.

FIG. 6A is a timing chart showing control of the mover 123A when the abutment 117 rotates forward. FIG. 6B is a timing chart showing control of the mover 123A when the abutment 117 rotates backward.

The mover 123A controlled by the degradation estimator 300 depicted in FIG. 4 performs the primary mode and the secondary mode at times shown in FIGS. 6A and 6B, respectively. The primary mode starts based on the number of sheets P and the conveyance time period of the sheet P in the print mode. The secondary mode is performed based on the estimated amount of heat provided by the heat amount estimator 200. The timing charts shown in FIGS. 6A and 6B show a first reference time when the number of sheets P or the conveyance time period of the sheet P reaches a given value before the estimated amount of heat reaches the threshold and a second reference time, after the first reference time, when the estimated amount of heat reaches the threshold.

As shown in FIGS. 6A and 6B, when the number of sheets P or the conveyance time period of the sheet P reaches the given value at a first elapsed time T1 counted after starting the fixing device 116, the primary mode is performed. In the primary mode, the abutment 117 contacts the fixing belt 116B for a first contact time period T1' longer than a second contact time period T2' in the secondary mode. It is because it takes longer for the abutment 117 to grind the outer circumferential surface of the fixing belt 116B than to wipe the outer circumferential surface of the fixing belt 116B to remove the toner particles and the additive therefrom. The ROM 301 prestores the contact time period. When the contact time period reaches a given value, the mover 123A separates the abutment 117 from the fixing belt 116B. The mover 123A brings the abutment 117 into contact with the fixing belt 116B according to the degradation level of the fixing belt 116B determined by the degradation estimator 300 based on the estimated amount of heat conducted to the sheet P passing through the fixing nip N, that is estimated by the heat amount estimator 200.

When the estimated amount of heat reaches the threshold, that is, at a second elapsed time T2 counted after starting the fixing device 116, the secondary mode starts and therefore the abutment 117 isolated from the fixing belt 116B comes into contact with the fixing belt 116B again. During the secondary mode, the abutment 117, while contacting the fixing belt 116B, rotates in a rotation direction at a linear velocity differential between the linear velocity of the abutment 117 and the linear velocity of the fixing belt 116B defined below.

FIG. 6A illustrates the timing chart when the abutment 117 rotates in a forward direction F117 in accordance with rotation of the fixing belt 116B rotating in the rotation direction DB shown in FIG. 2. In this case, in order to enhance grinding, the abutment 117 rotates faster at an increased linear velocity differential V0 between the linear velocity of the abutment 117 and the linear velocity of the fixing belt 116B that is greater than a decreased linear velocity differential in the secondary mode. Accordingly, when the abutment 117 rotates in the forward direction F117 in accordance with rotation of the fixing belt 116B, the increased linear velocity differential V0 increases chances for the abutment 117 to slide over the fixing belt 116B, enhancing grinding. Thus, the controller 400 controls the abutment 117 to rotate at an increased rotation speed while retaining the forward direction F117.

FIG. 6B illustrates the timing chart during the primary mode when the abutment 117 rotates in a backward direction B117 against rotation of the fixing belt 116B rotating in the rotation direction DB shown in FIG. 2. FIG. 6B illustrates the timing chart in which the abutment 117 rotates in the backward direction B117 at a decreased linear velocity differential V1 different from the timing chart shown in FIG. 6A in which the abutment 117 rotates in the forward direction F117 at the increased linear velocity differential V0. That is, in the primary mode, the abutment 117 rotates in the backward direction B117 against rotation of the fixing belt 116B rotating in the rotation direction DB shown in FIG. 2.

If the abutment 117 rotates in the backward direction B117 against the rotation direction DB of the fixing belt 116B, the abutment 117 increases a shear force exerted against the outer circumferential surface of the fixing belt 116B due to relative displacement. Accordingly, the abutment 117 grinds the outer circumferential surface of the fixing belt 116B effectively. Considering the increased shear force, the abutment 117 rotates at the decreased linear velocity differential V1 with respect to the fixing belt 116B that is smaller than the increased linear velocity differential V0. Thus, the abutment 117 retains grinding performance even under the decreased linear velocity differential V1.

If the rotation direction of the abutment 117 switches from the backward direction B117 to the forward direction F117, the abutment 117 smoothes the outer circumferential surface of the fixing belt 116B roughened by the shear force exerted to the fixing belt 116B during grinding, thus recovering the smoothness of the outer circumferential surface of the fixing belt 116B. It is to be noted that switching of the rotation direction of the abutment 117 between the forward direction F117 and the backward direction B117 is not mandatory. The abutment 117 performs grinding of the fixing belt 116B and removal of a foreign substance (e.g., the toner particles and the additive) from the fixing belt 116B by changing the linear velocity differential.

The abutment 117 serves as a grinder and a cleaner having a function different from that of the grinder and activating under a condition different from that under which the grinder works. Operating conditions of the abutment 117 are determined based on the parameters described above. In the controller 400, the heat amount estimator 200 calculates the estimated amount of heat according to the formulas (1) and (2) and sends it to the degradation estimator 300. The degradation estimator 300 compares the estimated amount of heat sent from the heat amount estimator 200 with the preset threshold and estimates the degradation level of the fixing belt 116B based on the comparison to control motion of the abutment 117.

A description is provided of control processes performed by the controller 400 to move the abutment 117 with respect to the fixing belt 116B.

Figure 7:
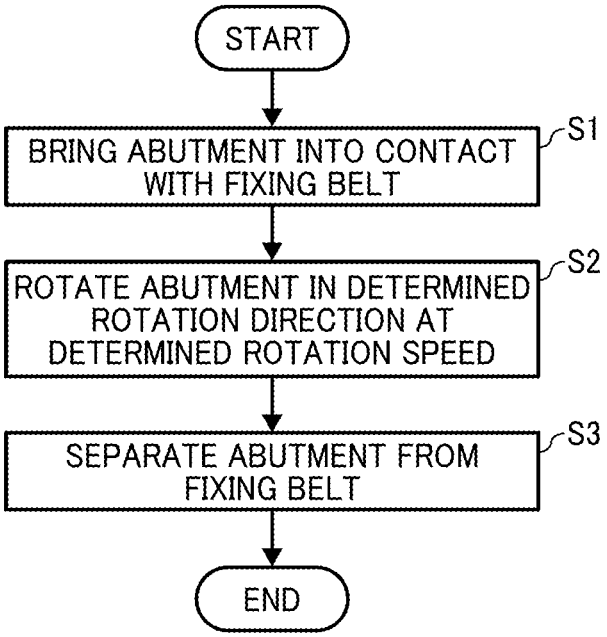
FIG. 7 is a flowchart showing control processes to move the abutment shown in FIG. 3 with respect to a fixing belt incorporated in the fixing device shown in FIG. 2.

FIG. 7 is a flowchart showing the control processes to move the abutment 117 with respect to the fixing belt 116B. As shown in FIG. 7, in step S1, the controller 400 brings the abutment 117 into contact with the fixing belt 116B with given pressure therebetween. In step S2, the controller 400 determines the rotation direction and the rotation speed of the abutment 117. While the abutment 117 in contact with the fixing belt 116B rotates in the determined rotation direction at the determined rotation speed, the abutment 117 grinds the outer circumferential surface of the fixing belt 116B, recovering a desired state of the outer circumferential surface of the fixing belt 116B. Alternatively, the abutment 117 grinds and cleans the outer circumferential surface of the fixing belt 116B, recovering the desired state of the outer circumferential surface of the fixing belt 116B and collecting and removing the toner particles and the additive from the fixing belt 116B. After a given time period elapses, that is, after the abutment 117 refreshes the outer circumferential surface of the fixing belt 116B and removes the toner particles and the additive adhered to the fixing belt 116B therefrom, the controller 400 separates the abutment 117 from the outer circumferential surface of the fixing belt 116B in step S3.

A description is provided of control processes performed by the controller 400 to control the abutment 117 according to the timing charts shown in FIGS. 6A and 6B.

Figure 8:
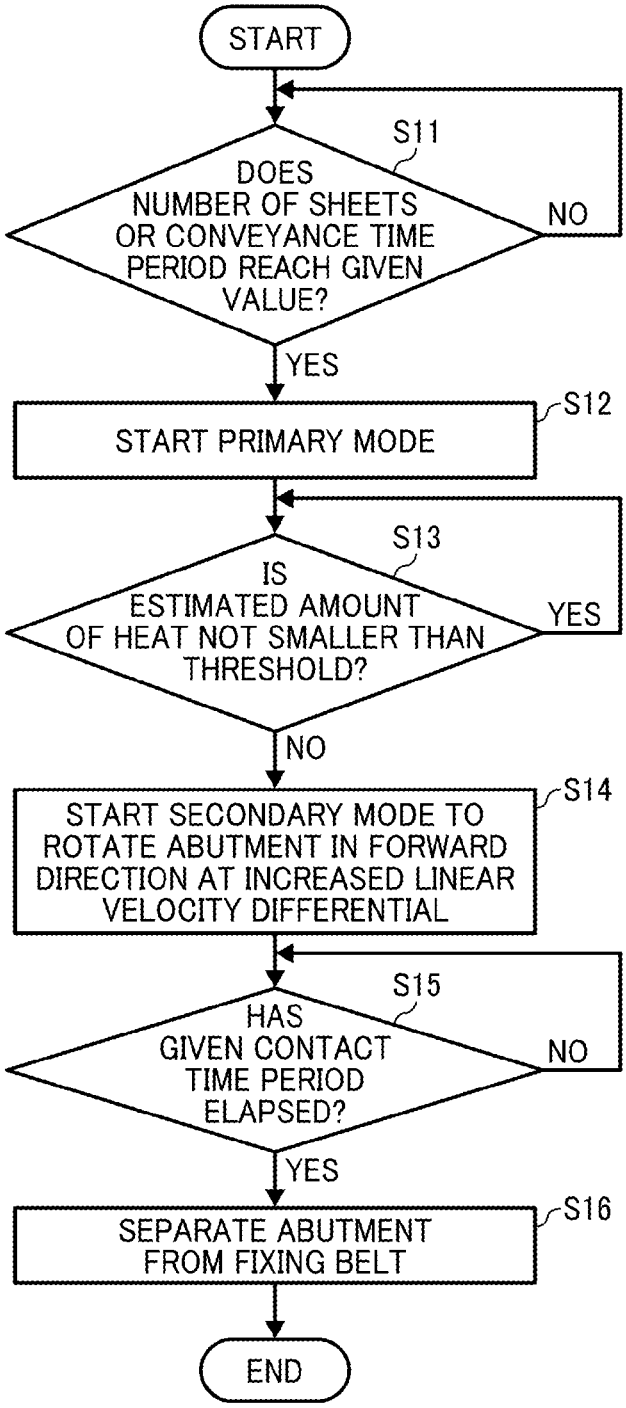
FIG. 8 is a flowchart showing control processes to control the abutment shown in FIG. 3 according to the timing chart shown in FIG. 6A.

FIG. 8 is a flowchart showing the control processes to control the abutment 117 according to the timing chart shown in FIG. 6A. As shown in FIG. 8, in step S11, the controller 400 determines whether or not at least one of the number of sheets P and the conveyance time period of the sheet P reaches the given value. If the at least one of the number of sheets P and the conveyance time period of the sheet P reaches the given value (YES in step S11), the controller 400 performs the primary mode according to the timing chart shown in FIG. 6A in step S12. Under the primary mode, the controller 400 performs the control processes indicated by steps S1 to S3 in FIG. 7.

The heat amount estimator 200 calculates the estimated amount of heat according to the formulas (1) and (2) and sends it to the degradation estimator 300. The degradation estimator 300 compares the estimated amount of heat sent from the heat amount estimator 200 with the threshold to determine whether or not the estimated amount of heat is not smaller than the threshold in step S13. If the controller 400 determines that the estimated amount of heat is not smaller than the threshold (NO in step S13), the controller 400 starts the secondary mode. For example, the controller 400 determines the rotation direction of the abutment 117 and the rotation speed of the abutment 117 that defines the linear velocity differential between the linear velocity of the abutment 117 and the linear velocity of the fixing belt 116B. Thus, the abutment 117 rotates in the forward direction F117 at the increased linear velocity differential V0 while contacting the fixing belt 116B in step S14. In step S15, the controller 400 determines whether or not a given contact time period has elapsed. If the controller 400 determines that the given contact time period has elapsed (YES in step S15), the abutment 117 stops after its rotation for the given time period while contacting the fixing belt 116B and the controller 400 separates the abutment 117 from the fixing belt 116B in step S16.

Through the control processes described above, as the abutment 117 rotates in the forward direction F117 in accordance with rotation of the fixing belt 116B rotating in the rotation direction DB after the primary mode, the abutment 117 wipes the toner particles and the additive adhered to the outer circumferential surface of the fixing belt 116B thereof by using the increased linear velocity differential V0, thus smoothing the outer circumferential surface of the fixing belt 116B.

Figure 9:
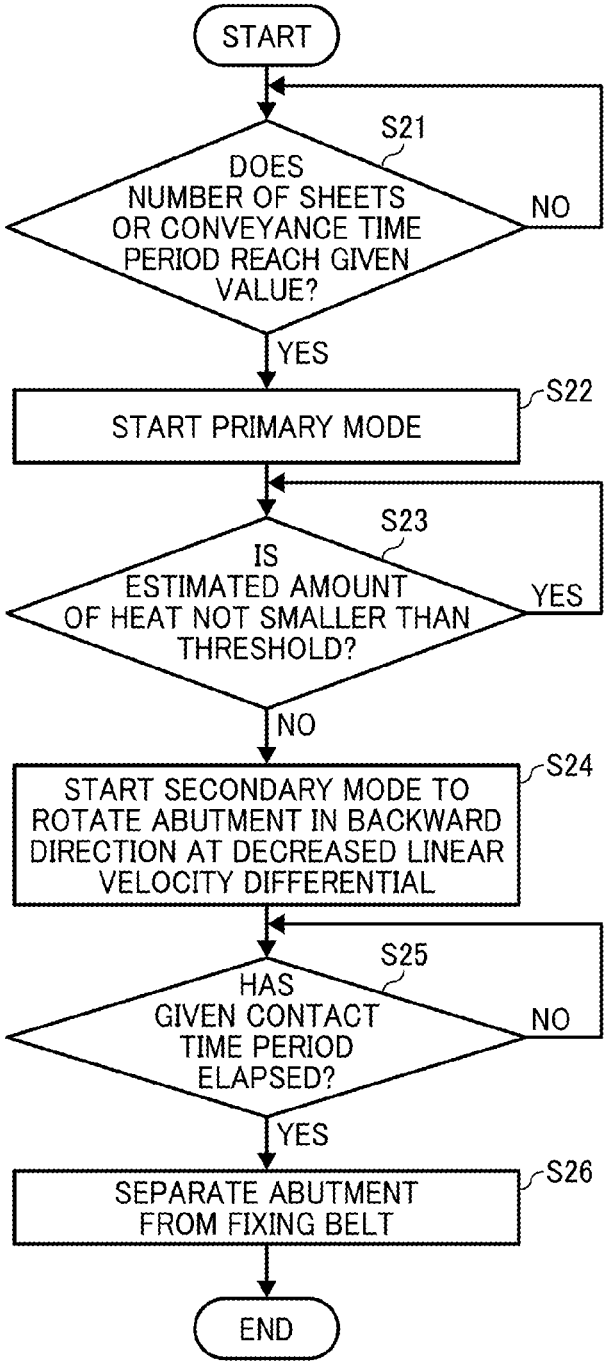
FIG. 9 is a flowchart showing control processes to control the abutment shown in FIG. 3 according to the timing chart shown in FIG. 6B.

FIG. 9 is a flowchart showing the control processes to control the abutment 117 according to the timing chart shown in FIG. 6B. As shown in FIG. 9, in step S21, the controller 400 determines whether or not at least one of the number of sheets P and the conveyance time period of the sheet P reaches the given value. If the at least one of the number of sheets P and the conveyance time period of the sheet P reaches the given value (YES in step S21), the controller 400 performs the primary mode according to the timing chart shown in FIG. 6B in step S22. Under the primary mode, the controller 400 performs the control processes indicated by steps S1 to S3 in FIG. 7 like in the control processes shown in FIG. 8.

The heat amount estimator 200 calculates the estimated amount of heat according to the formulas (1) and (2) and sends it to the degradation estimator 300. The degradation estimator 300 compares the estimated amount of heat sent from the heat amount estimator 200 with the threshold to determine whether or not the estimated amount of heat is not smaller than the threshold in step S23. If the controller 400 determines that the estimated amount of heat is not smaller than the threshold (NO in step S23), the controller 400 starts the secondary mode. For example, the controller 400 determines the rotation direction of the abutment 117 and the rotation speed of the abutment 117 that defines the linear velocity differential between the linear velocity of the abutment 117 and the linear velocity of the fixing belt 116B. Thus, the abutment 117 rotates in the backward direction B117 at the decreased linear velocity differential V1 smaller than the increased linear velocity differential V0 while contacting the fixing belt 116B in step S24. For example, the abutment 117 rotates in the backward direction B117 against the rotation direction DB of the fixing belt 116B. Accordingly, the abutment 117 rotates at the decreased linear velocity differential V1 smaller than the increased linear velocity differential V0 employed in the control processes shown in FIG. 8. In step S25, the controller 400 determines whether or not a given contact time period has elapsed. If the controller 400 determines that the given contact time period has elapsed (YES in step S25), the abutment 117 stops after its rotation for the given time period while contacting the fixing belt 116B and the controller 400 separates the abutment 117 from the fixing belt 116B in step S26.

Through the control processes described above, as the abutment 117 rotates in the backward direction B117 against the rotation direction DB of the fixing belt 116B after the primary mode, the abutment 117 wipes the toner particles and the additive adhered to the outer circumferential surface of the fixing belt 116B thereof by using the decreased linear velocity differential V1, thus smoothing the outer circumferential surface of the fixing belt 116B.

With the configuration and the control processes described above, the abutment 117, that is, a single component, achieves a plurality of functions performed under different operating conditions, that is, grinding of the fixing belt 116B and removal of the toner particles and the additive from the fixing belt 116B.

A description is provided of experimental results regarding the life of the fixing device 116 incorporating the abutment 117 described above.

A first experiment was conducted in the full-color image forming mode and the five-color image forming mode, that is, the special color image forming mode using the clear toner, in which the abutment 117 performs grinding of the fixing belt 116B and removal of the foreign substance (e.g., the toner particles and the additive) from the fixing belt 116B based on the estimated amount of heat calculated by the heat amount estimator 200 according to the formula (1). The first experiment shows that the life of the abutment 117 is prolonged by about 10 times in the full-color image forming mode. In the five-color image forming mode, at a usage rate of 50 percent in the full-color image forming mode and 50 percent in the five-color image forming mode, the life of the abutment 117 is prolonged by about 1.7 times.

Like the first experiment, a second experiment was conducted in the full-color image forming mode and the five-color image forming mode, that is, the special color image forming mode using the clear toner, in which the abutment 117 performs grinding of the fixing belt 116B and removal of the foreign substance (e.g., the toner particles and the additive) from the fixing belt 116B based on the estimated amount of heat calculated by the heat amount estimator 200 according to the formula (2). The second experiment shows that the life of the abutment 117 is prolonged by about 50 percent. That is, the life of the abutment 117 is prolonged by about 50 percent further than the life of the abutment 117 under control using the formula (1). An evaluation under average usage shows that the life of the abutment 117 is prolonged by about 50 percent.

The weighting coefficients c and d used in the formula (2), if they are defined based on the type and the thickness of the sheet P, decrease an occurrence rate of a faulty toner image such as a toner image having variation in gloss that may result from adhesion of the toner particles and the additive to the fixing belt 116B by about 75 percent. The evaluation under average usage shows that the life of the abutment 117 is prolonged by about 75 percent.

A description is provided of advantages of the linear velocity differential between the linear velocity of the fixing belt 116B and the linear velocity of the abutment 117.

A comparison was conducted between advantages attained with the linear velocity differential and advantages attained without the linear velocity differential. For example, results of the comparison are indicated by a removal rate of wax used as the additive when the abutment 117 rotates in the forward direction F117 in accordance with rotation of the fixing belt 116B rotating in the rotation direction DB as shown in FIGS. 2 and 6A. A wax adhesion rate of the wax adhered to the fixing belt 116B is calculated according to a formula (3) below by adhering the wax of an identical amount to the fixing belt 116B and measuring the weight of the fixing belt 116B before removal of the wax by the abutment 117 in the secondary mode.

$$r1=(w1-w2)/(w1-w3)\times 100 \quad (3)$$

In the formula (3), r1 represents a removal rate in percent of the wax. w1 represents a weight in gram of the fixing belt 116B before the secondary mode. w2 represents a weight in gram of the fixing belt 116B after the secondary mode. w3 represents a weight in gram of the fixing belt 116B not adhered with the wax.

Figure 10:
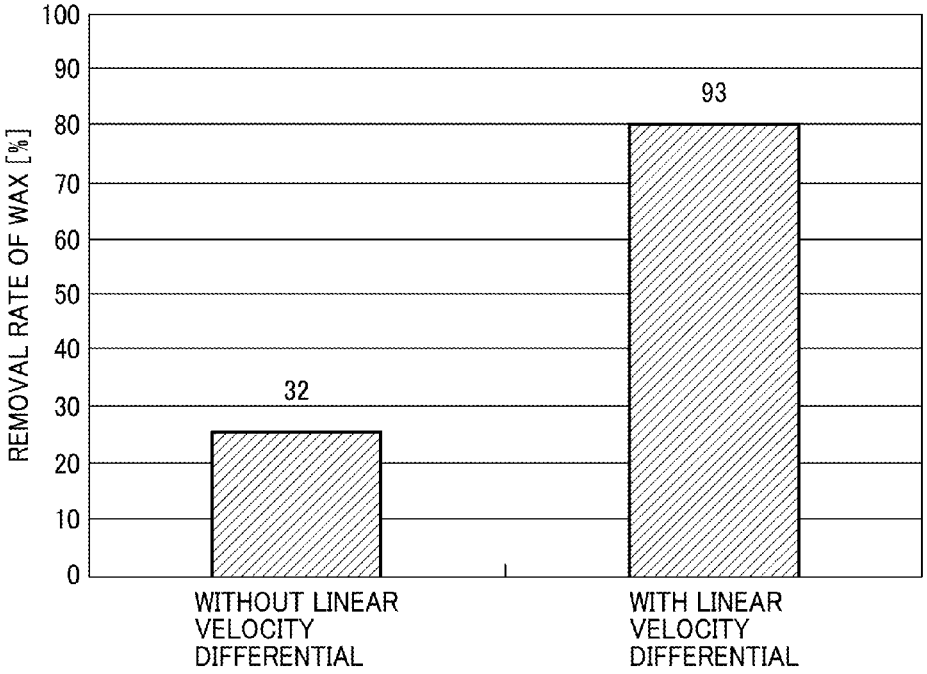
FIG. 10 is a graph showing a relation between application of a linear velocity differential between a linear velocity of the abutment and a linear velocity of the fixing belt and a removal rate of wax.

FIG. 10 is a graph showing a relation between application of the linear velocity differential and the removal rate of the wax calculated according to the formula (3). As shown in FIG. 10, the removal rate of the wax with the linear velocity differential is increased by about three times compared to the removal rate without the linear velocity differential.

A description is provided of estimation of the degradation level of the fixing belt 116B by considering the adhesion amount of the wax.

The degradation estimator 300 may estimate the degradation level of the fixing belt 116B based on which the abutment 117 grinds and cleans the fixing belt 116B by using the adhesion amount of the wax as the additive added to the toner particles. The amount of the wax added to a surface of the toner particle, even if the wax is added to the toner particles of an identical type, varies depending on the production lot. Accordingly, as the wax in an increased amount is added to the surface of the toner particles, a wax component on the toner particles adheres to the fixing belt 116B at an increased frequency. Conversely, as the wax in a decreased amount is added to the surface of the toner particle, the wax component on the toner particles adheres to the fixing belt 116B at a decreased frequency. To address this circumstance, the amount of the wax added to the toner particles is calculated into a toner property coefficient as toner property information. The toner property coefficient is multiplied by the number of sheets P to obtain a cumulative number of sheets P that is used to determine the degradation level of the fixing belt 116B like the example embodiment described above using the estimated amount of heat.

In this case, the cumulative number of sheets P obtained by multiplying the toner property coefficient calculated based on the amount of the wax contained in the toner by the number of sheets P is used as the estimated degradation level of the fixing belt 116B. As shown in FIG. 4, the cumulative number of sheets P is calculated by a cumulative number calculator 200P of the controller 400 activated instead of the heat amount estimator 200. The cumulative number of sheets P calculated by the cumulative number calculator 200P is sent to the degradation estimator 300 as data. When the cumulative number of sheets P reaches a given value, the degradation estimator 300 drives the mover 123A to bring the abutment 117 into contact with the fixing belt 116B.

The toner property coefficient indicates an amount of the wax added to the toner particles that is controlled per production lot of a toner bottle that contains fresh toner. According to this example embodiment, the toner property coefficient is controlled with a tolerance in a range of 1.0 plus and minus 0.3 with a tolerance center of 1.0 before shipment of the toner bottle. As shown in FIG. 1, the image forming apparatus 100 further includes toner bottles T1, Y1, M1, C1, and K1 that contain fresh clear, yellow, magenta, cyan, and black toners, respectively. Each of the toner bottles T1, Y1, M1, C1, and K1 mounts an integrated circuit (IC) chip that stores the toner property coefficient. FIG. 1 illustrates an IC chip T1S of the toner bottle T1 containing the fresh clear toner and omits the IC chip of the respective toner bottles Y1, M1, C1, and K1. The cumulative number of sheets P is calculated by using the toner property coefficient in the monochrome image forming mode according to a formula (4) below.

$$s1=a1\times n \tag{4}$$

In the formula (4), s1 represents the cumulative number of sheets P. a1 represents the toner property coefficient. n represents the number of sheets P conveyed through the fixing nip N.

Figure 11:
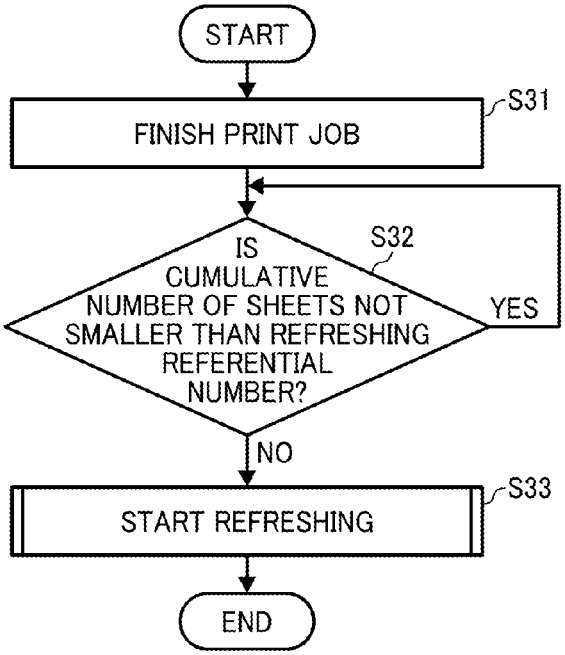
FIG. 11 is a flowchart showing control processes to control the abutment shown in FIG. 3 based on a degradation level of the fixing belt incorporated in the fixing device shown in FIG. 2.

The controller 400 compares the cumulative number of sheets P with a preset refreshing referential number of sheets P conveyed through the fixing nip N (hereinafter referred to as the refreshing referential number of sheets P) to determine whether or not to start refreshing the fixing belt 116B based on the cumulative number of sheets P. If the cumulative number of sheets P exceeds the refreshing referential number of sheets P, the controller 400 controls the mover 123A to bring the abutment 117 into contact with the fixing belt 116B. FIG. 11 is a flowchart showing control processes for controlling the abutment 117 based on the degradation level of the fixing belt 116B estimated by considering the adhesion amount of the wax. As shown in FIG. 11, in step S31, a print job finishes. In step S32, the degradation estimator 300 determines whether or not the cumulative number of sheets P is not smaller than the refreshing referential number of sheets P. That is, the degradation estimator 300 conducts determination in step S32 whenever the print job finishes. If the degradation estimator 300 determines that the cumulative number of sheets P is not smaller than the refreshing referential number of sheets P (NO in step S32), the controller 400 starts refreshing in step S33. For example, refreshing includes the primary mode and the secondary mode shown in FIGS. 8 and 9, thus removing the wax from the fixing belt 116B.

When calculating the cumulative number of sheets P, if the plurality of toners in different colors is used in the print modes to form the full-color toner image, an average of the toner property coefficients in the four colors (e.g., the yellow, magenta, cyan, and black toners) is used as weighting for the number of sheets P as shown in a formula (5) below.

$$s2=(b1+c1+d1+e)/4\times n \tag{5}$$

In the formula (5), s2 represents the cumulative number of sheets P. b1 represents a cyan toner property coefficient. c1 represents a magenta toner property coefficient. d1 represents a yellow toner property coefficient. e represents a black toner property coefficient. n represents the number of sheets P conveyed through the fixing nip N.

The print mode to form the monochrome toner image and the print mode to form the full-color toner image may be mixed in a print job. In this case, the fixing temperature at which the toner image is fixed on the sheet P varies depending on the print mode. For example, the print mode to form the monochrome toner image consumes a decreased total amount of toner adhered to the sheet P compared to the print mode to form the full-color toner image that consumes an increased total amount of toner adhered to the sheet P. Hence, a decreased fixing temperature is applied to the print mode to form the monochrome toner image. Conversely, an increased fixing temperature is applied to the print mode to form the full-color toner image. Accordingly, in a print mode history with mixture of the different print modes, the cumulative number of sheets P in each print mode is used to perform correction to address variation in the fixing temperature with respect to each cumulative number of sheets P. The cumulative number of sheets P in each print mode is obtained by multiplying the toner property coefficient by the number of sheets P as shown in the formulas (4) and (5). When the different print modes are mixed, the cumulative number of sheets P in each print mode is calculated with weighting coefficients, that is, print mode coefficients α and β in each print mode as shown in a formula (6) below.

$$s3=\{\alpha\times(b1+c1+d1+e)/4\times n\}+\{\beta\times e\times n\} \tag{6}$$

In the formula (6), s3 represents the cumulative number of sheets P. α and β represent the print mode coefficient in the full-color image forming mode and the print mode coefficient in the monochrome image forming mode, respectively. The print mode coefficient is the weighting coefficient corresponding to variation in adhesion of the wax to the fixing belt 116B caused by variation in the fixing temperature depending on the print mode as described above.

According to this example embodiment, effusion of the wax decreases at a decreased fixing temperature during a fixing process to fix the toner image on the sheet P and therefore the wax adheres to the fixing belt 116B in a decreased amount. Hence, the print mode coefficient α in the full-color image forming mode is 1.0 and the print mode coefficient β in the monochrome image forming mode is 0.5.

The print mode coefficients α and β are adjusted according to the construction of the fixing device 116, the fixing temperature, a physical property of the toner, and the like.

The above refers to the monochrome image forming mode or the full-color image forming mode as the print mode. In addition, the print mode to form the toner image in the special color with the special color toner (e.g., the clear toner and the white toner) to enhance the glossiness of the toner image formed on the sheet P, that is, the special color image forming mode, is available.

The special color image forming mode consumes the total amount of toner transferred onto the sheet P, which is greater than that in the full-color image forming mode. To address this circumstance, the process linear velocity of the fixing belt 116B to conduct heat to the sheet P sufficiently in the special color image forming mode is lower than that in the full-color image forming mode. For example, the process linear velocity of the fixing belt 116B in the monochrome image forming mode or the full-color image forming mode is about 500 mm/sec. Conversely, the process linear velocity of the fixing belt 116B in the special color image forming mode is decreased to about 250 mm/sec.

The sheet P conveyed at the decreased process linear velocity passes through the fixing nip N depicted in FIG. 2 for an increased time, increasing effusion of the wax to the fixing belt 116B and therefore accelerating adhesion of the wax to the fixing belt 116B. In this case, the cumulative number of sheets P is calculated with a print mode coefficient greater than the print mode coefficient $\alpha$ in the full-color image forming mode. For example, the print mode coefficient $\alpha$ in the full-color image forming mode is 1.0. The print mode coefficient $\beta$ in the monochrome image forming mode is 0.5. A print mode coefficient $\gamma$ in the special color image forming mode is 2.0 greater than the print mode coefficient $\alpha$ in the full-color image forming mode. Thus, when the different print modes are mixed, the cumulative number of sheets P is calculated by weighting varying depending on the print mode according to a formula (7) below.

$$s4=\{\alpha\times(b1+c1+d1+e)/4\times n\}+\{\beta\times e\times n\}+\{\gamma\times(b1+c1+d1+e+f)/5\times n\} \quad (7)$$

In the formula (7), s4 represents the cumulative number of sheets P. f represents a clear toner property coefficient. The print mode coefficients $\alpha$, $\beta$, and $\gamma$ are adjusted according to the construction of the fixing device 116, the fixing temperature, the physical property of the toner, and the like.

Thus, the cumulative number of sheets P corresponding to the print mode is calculated by weighting using the toner property coefficient and the print mode coefficient. Accordingly, refreshing of the fixing belt 116B is not performed excessively, preventing or suppressing degradation in the life of the abutment 117 serving as a grinder or a wiper and formation of a faulty toner image caused by insufficient refreshing of the outer circumferential surface of the fixing belt 116B.

A description is provided of estimation of the degradation level of the fixing belt 116B by considering the type and the thickness of the sheet P.

The degradation estimator 300 may estimate the degradation level of the fixing belt 116B based on which the abutment 117 grinds and cleans the fixing belt 116B by using the weighting coefficient defined based on the type and the thickness of the sheet P per brand. The sheet P per brand, that is, a brand sheet, defines a sheet having a specification different in paper weight, thickness, and the like from other sheet of an identical type (e.g., plain paper, coated paper, and non-coated paper) due to variation in manufacturer and therefore having a fixing temperature different from that of other sheet. To address this circumstance, according to this example embodiment, the controller 400 detects the brand of the sheet P, presets a sheet type-thickness coefficient peculiar to each brand as the weighting coefficient, and estimates the degradation level of the fixing belt 116B based on the cumulative number of sheets P obtained by multiplying the number of sheets P by the sheet type-thickness coefficient.

As shown in FIG. 4, the cumulative number of sheets P is calculated by the cumulative number calculator 200P of the controller 400 activated instead of the heat amount estimator 200. The cumulative number of sheets P calculated by the cumulative number calculator 200P is sent to the degradation estimator 300 as data. When the cumulative number of sheets P reaches a given value, the degradation estimator 300 drives the mover 123A to bring the abutment 117 into contact with the fixing belt 116B.

The cumulative number calculator 200P uses a sheet type-thickness coefficient a2 for each brand sheet shown in Table 2 below, for example.

TABLE 2

| Brand sheet | Paper weight | Process linear velocity | Fixing temperature | Sheet type-thickness coefficient a2 |
|---|---|---|---|---|
| A | 80 gsm | Standard velocity | 140° C. | 0.5 |
| B | 250 gsm | Standard velocity | 160° C. | 1 |
| C | 360 gsm | Standard velocity | 180° C. | 1.5 |
| D | 250 gsm | Standard velocity | 200° C. | 3 |

The fixing temperature as a fixing condition tends to increase as the thickness of the sheet P increases. Since a brand sheet D is special paper, that is, thick paper having an increased thickness, the brand sheet D is applied with a fixing temperature higher than that applied to a brand sheet B having an identical paper weight.

Under the increased fixing temperature, as described above, a toner component contained in the toner, such as the wax, may adhere to the outer circumferential surface of the fixing belt 116B in an increased amount. To address this circumstance, the sheet type-thickness coefficient a2 used as the weighting coefficient when the controller 400 calculates the cumulative number of sheets P used for determining the degradation level of the fixing belt 116B is also increased. The cumulative number of sheets P used for determining the degradation level of the fixing belt 116B is calculated by using the number of sheets P and the sheet type-thickness coefficient a2 for each brand sheet according to a formula (8) below corresponding to the formula (4).

$$s5=a2\times n \quad (8)$$

In the formula (8), s5 represents the cumulative number of sheets P. The degradation estimator 300 determines the degradation level of the fixing belt 116B based on the cumulative number of sheets P and controls the mover 123A to move the abutment 117 according to the control processes shown in FIG. 11.

In addition to the detected brand of the sheet P, the sheet type-thickness coefficient a2 is determined based on the total amount of toner adhered to the sheet P in the print mode using the detected brand of the sheet P and the fixing condition such as the process linear velocity of the fixing belt 116B to convey the sheet P so as to attain the fixing property of heating the fixing belt 116B sufficiently. For example, Table 3 shows the sheet type-thickness coefficients b2 and c2 defined based on the print mode, the total amount of toner adhered to the sheet P in the print mode, and the process linear velocity regarding brand sheets E and F having different paper weights, respectively. The sheet type-thickness coefficients b2 and c2 correspond to different print modes, respectively.

TABLE 3

| Brand sheet | Paper weight | Print mode | Total amount of toner | Process linear velocity | Sheet type-thickness coefficient b2, c2 |
|---|---|---|---|---|---|
| E | 80 gsm | Full-color image forming mode | 260% | Standard velocity (415 mm/sec) | 0.5 |
| | | Five-color clear image forming mode | 360% | Decreased velocity (176 mm/sec) | 0.3 |
| F | 250 gsm | Full-color image forming mode | 260% | Standard velocity (415 mm/sec) | 1 |
| | | Five-color clear image forming mode | 360% | Decreased velocity (176 mm/sec) | 0.8 |

Factors used to determine the sheet type-thickness coefficient are the brand of the sheet P, the fixing temperature, the process linear velocity, and the total amount of toner adhered to the sheet P that affect adhesion of the toner component such as the wax to the fixing belt 116B. According to this example embodiment, the sheet type-thickness coefficient is calculated by, primarily, setting an upper limit of the total amount of toner adhered to the sheet P, and, secondarily, using an experimental result of an experiment for examining an initial sheet P of a plurality of sheets P on which a solid toner image is formed continuously, where variation in gloss of the solid toner image appears. The sheet type-thickness coefficient is changed arbitrarily according to an image forming system, the construction of the fixing device 116, and a specification of the toner image such as the glossiness regardless of the conditions described above.

The sheet type-thickness coefficient is applicable to the full-color image forming mode and the five-color image forming mode like the weighting coefficients a and b used in the formula (1). The full-color image forming mode actuates the four image forming stations 10Y, 10M, 10C, and 10K depicted in FIG. 1. The five-color image forming mode actuates the five image forming stations 10T, 10Y, 10M, 10C, and 10K by driving the image forming station 10T that uses the clear toner to enhance the glossiness of the toner image in addition to the yellow, magenta, cyan, and the black toners.

Even if the sheet P of the identical brand is used, the total amount of toner adhered to the sheet P in the five-color image forming mode is greater than that in the full-color image forming mode. As the total amount of toner adhered to the sheet P increases, as described above, the toner component such as the wax is susceptible to adhesion to the fixing belt 116B. Accordingly, the sheet type-thickness coefficient is determined considering the process linear velocity selected based on the fixing temperature to heat the toner adhered to the sheet P to fix the toner image thereon.

A description is provided of the sheet type-thickness coefficient determined considering the process linear velocity.

The process linear velocity of the fixing belt 116B to convey the sheet P may adversely affect adhesion of the toner component to the fixing belt 116B. Even if the sheet P of the identical brand is used, the process linear velocity varies depending on the print mode. For example, even if the sheet P is conveyed at a standard velocity in the full-color image forming mode, the sheet P is conveyed at a decreased process linear velocity in the five-color image forming mode to attain glass transition so as to improve the quality in glossiness of the toner image. Accordingly, an increased fixing temperature is applied to the sheet P conveyed at an increased process linear velocity to heat the fixing belt 116B sufficiently. Consequently, the sheet type-thickness coefficient is increased to address increase in effusion of the toner component.

A description is provided of the sheet type-thickness coefficient varying depending on the print mode with the identical brand sheet.

Toners used to form the toner image on the sheet P include the yellow, magenta, cyan, and black toners referred to in the above description of the formula (1) and the special color toner such as the clear toner and the white toner. Optionally, a fluorescent color toner may be used as the special color toner.

The print modes using those toners include the full-color image forming mode that actuates the four image forming stations 10Y, 10M, 10C, and 10K and special color image forming modes that actuate the five image forming stations 10T, 10Y, 10M, 10C, and 10K including the image forming station 10T that uses the special color toner. The special color image forming modes include a five-color clear image forming mode, a five-color white image forming mode, and a five-color fluorescent image forming mode. Those print modes are selectively activated.

Table 4 shows sheet type-thickness coefficients d2, e1, and f defined based on the print mode, the total amount of toner adhered to the sheet P, and the process linear velocity regarding an identical brand sheet G.

TABLE 4

| Brand sheet | Paper weight | Print mode | Total amount of toner | Process linear velocity | Sheet type-thickness coefficient d2, e1, f |
|---|---|---|---|---|---|
| G | 250 gsm | Full-color image forming mode | 260% | Standard velocity (415 mm/sec) | 1 |
| | | Five-color clear image forming mode | 360% | Decreased velocity (176 mm/sec) | 0.8 |
| | | Five-color white image forming mode | 360% | Medium velocity (352.8 mm/sec) | 1.2 |
| | | Five-color fluorescent image forming mode | 360% | Medium velocity (352.8 mm/sec) | 4.5 |

As shown in Table 4, the total amount of toner in the special color image forming modes using the special color toner, that is, the five-color clear image forming mode, the five-color white image forming mode, and the five-color fluorescent image forming mode, is greater than the total amount of toner in the full-color image forming mode. Accordingly, considering increase in the toner component in the special color image forming modes, the sheet type-thickness coefficient in the special color image forming modes is greater than that in the full-color image forming mode.

Susceptibility of the special color toners to adhesion to the fixing belt 116B varies as below due to variation in the fixing temperature relating to a formula of the special color toners. The fluorescent toner is more susceptible to adhesion than the clear toner. The clear toner is equal to the white, yellow, magenta, cyan, and black toners in the susceptibility to adhesion. The fixing temperature varies because an appropriate fixing temperature is selected according to the process linear velocity to heat the fixing belt 116B sufficiently to fix the toner image on the sheet P.

Even if the sheet P of the identical brand is used, the process linear velocity in the print modes using those toners varies depending on the fixing temperature as described above. For example, the sheet P is conveyed at a standard velocity in the full-color image forming mode. Conversely, the sheet P is conveyed at a medium velocity in the five-color white image forming mode and the five-color fluorescent image forming mode to achieve a fixing property of heating the fixing belt 116B sufficiently.

In the five-color clear image forming mode, the sheet P is conveyed at a decreased velocity to facilitate glass transition and therefore improve the quality in gloss of the toner image formed on the sheet P. Accordingly, the sheet type-thickness coefficient is defined in each mode by considering that the susceptibility of the toner component to the fixing belt 116B varies depending on the process linear velocity selected.

Even at the identical process linear velocity, the sheet type-thickness coefficient varies depending on the formula of the toner used in the print mode. For example, although the identical process linear velocity is selected in each of the five-color white image forming mode and the five-color fluorescent image forming mode, if the fluorescent toner of which toner component is susceptible to adhesion to the fixing belt 116B is used, the sheet type-thickness coefficient is increased. Accordingly, the sheet type-thickness coefficient used to determine the degradation level of the fixing belt 116B in the five-color fluorescent image forming mode differs from the sheet type-thickness coefficient used in other print modes.

The heat amount estimator 200 may not precisely determine the estimated amount of heat that should be estimated according to the amount of toner used to form the toner image based on the number of sheets P conveyed through the fixing nip N only as defined by the formula (1). For example, since the sheets P having the identical size may be conveyed at different process linear velocities according to the type of toner and the print rate (e.g., an image area rate of an imaged area, that is, the toner image, relative to the sheet P), heat in different amounts may be conducted to the sheets P, respectively. Since the heat amount estimator 200 does not identify the size of the sheet P based on the number of sheets P, it may be difficult for the heat amount estimator 200 to calculate a cumulative value of the imaged area that affects the level of effusion of the toner component. To address this circumstance, the heat amount estimator 200 may calculate the estimated amount of heat conducted to the fixing belt 116B based on the conveyance time period of the sheet P as defined by formulas (9) to (11) below.

$$t6=\alpha 1\times t \tag{9}$$

In the formula (9), t6 represents a cumulative conveyance time period of sheets P conveyed through the fixing nip N. $\alpha 1$ represents the sheet type-thickness coefficient defined according to the type of the sheet P. t represents the conveyance time period of the sheet P. The conveyance time period of the sheet P is used instead of the number of sheets P conveyed through the fixing nip N in the formula (8).

$$t7=\beta 1\times t4+\gamma 1\times t5c \tag{10}$$

In the formula (10), t7 represents the cumulative conveyance time period of sheets P conveyed through the fixing nip N. $\beta 1$ represents the sheet type-thickness coefficient in the full-color image forming mode that actuates the four image forming stations 10Y, 10M, 10C, and 10K. $\gamma 1$ represents the sheet type-thickness coefficient in the five-color clear image forming mode that actuates the five image forming stations 10T, 10Y, 10M, 10C, and 10K. t4 represents the conveyance time period of the sheet P in the full-color image forming mode. t5c represents the conveyance time period of the sheet P in the five-color clear image forming mode. In the formula (10), the conveyance time period of the sheet P is used as it is used in the formula (2).

$$t8=\delta 1\times t4+\epsilon\times t5c+\zeta\times t5w+\eta\times t5f \tag{11}$$

In the formula (11), t8 represents the cumulative conveyance time period of sheets P conveyed through the fixing nip N. $\delta 1$ represents the sheet type-thickness coefficient in the full-color image forming mode that actuates the four image forming stations 10Y, 10M, 10C, and 10K. $\epsilon$ represents the sheet type-thickness coefficient in the five-color clear image forming mode that actuates the five image forming stations 10T, 10Y, 10M, 10C, and 10K. $\zeta$ represents the sheet type-thickness coefficient in the five-color white image forming mode that actuates the five image forming stations 10T, 10Y, 10M, 10C, and 10K. $\eta$ represents the sheet type-thickness coefficient in the five-color fluorescent image forming mode that actuates the five image forming stations 10T, 10Y, 10M, 10C, and 10K. t5w represents the conveyance time period of the sheet P in the five-color white image forming mode. t5f represents the conveyance time period of the sheet P in the five-color fluorescent image forming mode. The formula (11) incorporates the five-color fluorescent image forming mode in addition to the modes incorporated in the formula (10) and the conveyance time period of the sheet P as it is incorporated in the formula (2).

As shown in FIG. 4, the cumulative conveyance time period is calculated by a cumulative conveyance time period calculator 200T of the controller 400 activated instead of the heat amount estimator 200. The cumulative conveyance time period calculated by the cumulative conveyance time period calculator 200T is sent to the degradation estimator 300 as data. When the cumulative conveyance time period reaches a given value, the degradation estimator 300 drives the mover 123A to bring the abutment 117 into contact with the fixing belt 116B.

Figure 12:
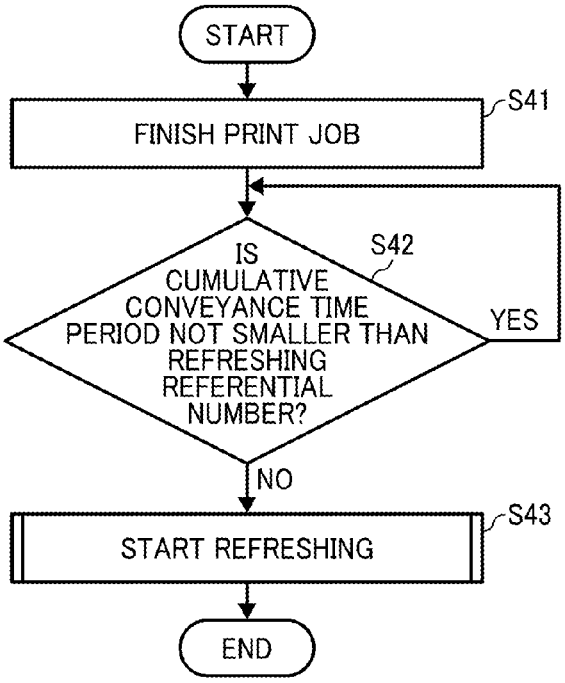
FIG. 12 is a flowchart showing control processes using a conveyance time period of a sheet conveyed through the fixing device shown in FIG. 2.

FIG. 12 is a flowchart showing control processes using the conveyance time period of the sheet P that is conducted by the controller 400. The control process in step S32 in FIG. 11 is replaced with a control process in step S42 in FIG. 12. For example, the cumulative number of sheets P in step S32 is replaced with the cumulative conveyance time period in step S42.

As shown in FIG. 12, in step S41, a print job finishes. In step S42, the degradation estimator 300 determines whether or not the cumulative conveyance time period of sheets P is not smaller than the refreshing referential number of sheets P. If the degradation estimator 300 determines that the cumulative conveyance time period of sheets P is not smaller than the refreshing referential number of sheets P (NO in step S42), the controller 400 starts refreshing in step S43.

Thus, the degradation estimator 300 estimates the degradation level of the fixing belt 116B based on the cumulative conveyance time period sent from the cumulative conveyance time period calculator 200T instead of the cumulative number of sheets P sent from the cumulative number calculator 200P.

The controller 400 calculating the cumulative number of sheets P according to the print mode with weighting as described above prohibits excessive refreshing of the fixing belt 116B, preventing or suppressing degradation in the life of the abutment 117 serving as a grinder or a wiper and formation of a faulty toner image caused by insufficient refreshment of the outer circumferential surface of the fixing belt 116B.

The present disclosure is not limited to the details of the example embodiments described above and various modifications and improvements are possible. For example, instead of the fixing belt 116B serving as a first rotator, the fixing roller 116A may serve as a first rotator. In this case, the fixing belt 116B is eliminated and the fixing roller 116A contacts the toner image on the sheet P. According to the example embodiments described above, the abutment 117 contacts the fixing belt 116B as shown in FIG. 2. Alternatively, the abutment 117 may contact the pressure roller 116C or both the fixing belt 116B and the pressure roller 116C.

A description is provided of advantages of the fixing device 116.

As shown in FIG. 2, the fixing device 116 includes a first rotator (e.g., the fixing belt 116B) and a second rotator (e.g., the pressure roller 116C) contacting the first rotator to form the fixing nip N therebetween through which a recording medium (e.g., a sheet P) bearing a toner image is conveyed. A heater (e.g., the heater H) is disposed opposite the first rotator to heat the first rotator. An abutment (e.g., the abutment 117) contacts at least one of the first rotator and the second rotator to refresh an outer circumferential surface of the at least one of the first rotator and the second rotator. A mover (e.g., the mover 123A) is connected to the abutment to move the abutment with respect to the at least one of the first rotator and the second rotator. As shown in FIG. 4, a controller (e.g., the controller 400) estimates a degradation level of the outer circumferential surface of the at least one of the first rotator and the second rotator and controls the mover to adjust motion of the abutment with respect to the at least one of the first rotator and the second rotator according to the degradation level of the at least one of the first rotator and the second rotator.

Accordingly, the mover brings the abutment into contact with the at least one of the first rotator and the second rotator according to the estimated degradation level. The abutment grinds the at least one of the first rotator and the second rotator or removes toner particles and an additive (e.g., wax) contained in toner from the at least one of the first rotator and the second rotator, refreshing the outer circumferential surface of the at least one of the first rotator and the second rotator and therefore preventing or suppressing variation or change in the glossiness of the toner image fixed on the recording medium.

The advantages achieved by the fixing device 116 are not limited to those described above.

According to the example embodiments described above, the fixing belt 116B serves as a first rotator. Alternatively, a fixing roller or the like may be used as a first rotator. Further, the pressure roller 116C serves as a second rotator. Alternatively, a pressure belt or the like may be used as a second rotator.

The present disclosure has been described above with reference to specific example embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative example embodiments may be combined with each other and/or substituted for each other within the scope of the present disclosure.

What is claimed is:

1. A fixing device comprising:

a first rotator rotatable in a given direction of rotation;

a second rotator, contacting the first rotator, configured to form a fixing nip therebetween through which a recording medium bearing a toner image is conveyed;

a heater, opposite to at least one of the first rotator and the second rotator, configured to heat at least one of the first rotator and the second rotator;

an abutment, separably contacting the first rotator, configured to clean an outer circumferential surface of the first rotator;

a mover, connected to the abutment, configured to move the abutment with respect to the first rotator;

a controller, including:

a degradation estimator, operatively connected to the mover, configured to estimate a degradation level of the outer circumferential surface of the first rotator and control the mover to move the abutment with respect to the first rotator according to the degradation level of the first rotator;

a heat amount estimator, operatively connected to the degradation estimator, configured to estimate an amount of heat conducted to the recording medium conveyed through the fixing nip; and a cumulative number calculator, operatively connected to the degradation estimator, configured to calculate a cumulative number of recording media by multiplying a toner property coefficient determined based on an amount of an additive contained in toner of the toner image by a number of recording media conveyed through the fixing nip, wherein the cumulative number calculator is configured to calculate the cumulative number of recording media by multiplying an average in the toner property coefficient of the toner in a plurality of colors used to form the toner image by the number of recording media conveyed through the fixing nip and a weighting coefficient determined based on a number of colors of the toner, and wherein the degradation estimator is configured to estimate the degradation level of the first rotator based on the amount of heat estimated by the heat amount estimator.

2. The fixing device according to claim 1, wherein the degradation estimator is configured to bring the abutment into contact with the first rotator when the cumulative number of recording media reaches a given value.

3. The fixing device according to claim 1, wherein the abutment includes a roller having a length in an axial direction thereof that corresponds to an increased width of the recording medium.

4. The fixing device according to claim 1, wherein the abutment is configured to rotate while contacting the first rotator.

5. The fixing device according to claim 4, wherein the mover is configured to rotate the abutment in one of a forward direction in which the abutment rotates in accordance with rotation of the first rotator at a first linear velocity and a backward direction in which the abutment rotates against rotation of the first rotator at a second linear velocity different from the first linear velocity.

6. The fixing device according to claim 1, wherein the degradation estimator is configured to adjust a contact time period when the abutment contacts the first rotator and a linear velocity at which the abutment rotates according to the degradation level of the first rotator.

7. The fixing device according to claim 6, wherein the heat amount estimator is configured to estimate the amount of heat conducted to the recording medium based on a cumulative value of at least one of a number of recording media conveyed through the fixing nip and a conveyance time period of the recording media, and wherein the degradation estimator is configured to compare the amount of heat with a preset value and determines the contact time period and the linear velocity of the abutment based on a comparison result.

8. The fixing device according to claim 1, wherein the heat amount estimator is configured to estimate the amount of heat conducted to the recording medium based on a fixing temperature of toner in a particular color used to form the toner image and an image area rate of the toner image formed with the toner in the particular color relative to the recording medium.

9. The fixing device according to claim 1, wherein the heat amount estimator is configured to estimate the amount of heat conducted to the recording medium based on a fixing temperature defined according to at least one of a thickness and a type of the recording medium.

10. The fixing device according to claim 9, wherein the heat amount estimator is configured to change a weighting coefficient based on a type of toner of the toner image contacting the first rotator when the heat amount estimator estimates the amount of heat conducted to the recording medium.

11. The fixing device according to claim 10, wherein the type of toner includes one of yellow, magenta, cyan, black, white, clear, and fluorescent toners used to form one of a monochrome toner image, a full-color toner image, a glossy toner image having a variable glossiness, and a spot color toner image.

12. The fixing device according to claim 9, wherein the heat amount estimator is configured to change a weighting coefficient based on one of the type and the thickness of the recording medium contacting the first rotator when the heat amount estimator estimates the amount of heat conducted to the recording medium.

13. The fixing device according to claim 12, wherein the type of the recording medium includes one of plain paper, coated paper, non-coated paper, and a brand sheet.

14. The fixing device according to claim 1, wherein the degradation estimator is configured to selectively perform a primary mode in which the abutment, while rotating, contacts and grinds the outer circumferential surface of the first rotator and a secondary mode in which the abutment, while rotating, contacts the outer circumferential surface of the first rotator to wipe at least one of toner and an additive thereof according to the degradation level of the first rotator, and wherein the degradation estimator is configured to adjust at least one of a contact start time when the abutment comes into contact with the first rotator, a contact time period when the abutment contacts the first rotator, a rotation direction in which the abutment rotates, and a linear velocity at which the abutment rotates.

15. The fixing device according to claim 14, wherein the degradation estimator is configured to start the primary mode when one of a number of recording media conveyed through the fixing nip and a conveyance time period when the recording media are conveyed through the fixing nip reaches a given value, and wherein the degradation estimator is configured to start the secondary mode when one of the number of recording media conveyed through the fixing nip, the conveyance time period when the recording media are conveyed through the fixing nip, and the estimated amount of heat conducted to the recording media reaches a preset threshold.

16. The fixing device according to claim 14, wherein the mover is configured to rotate the abutment in the primary mode in one of a forward direction in which the abutment rotates in accordance with rotation of the first rotator and a backward direction in which the abutment rotates against rotation of the first rotator with a first linear velocity differential between a linear velocity of the abutment and a linear velocity of the first rotator.

17. The fixing device according to claim 16, wherein the mover is configured to rotate the abutment in the secondary mode in one of the forward direction and the backward direction with a second linear velocity differential between the linear velocity of the abutment and the linear velocity of the first rotator that is smaller than the first linear velocity differential.

18. An image forming apparatus comprising:

an image forming device configured to form a toner image on a recording medium; and a fixing device, provided downstream from the image forming device in a recording medium conveyance direction, configured to fix the toner image on the recording medium, the fixing device including:

a first rotator rotatable in a given direction of rotation;

a second rotator, contacting the first rotator, configured to form a fixing nip therebetween through which the recording medium bearing the toner image is conveyed;

a heater, opposite to at least one of the first rotator and the second rotator, configured to heat at least one of the first rotator and the second rotator;

an abutment, separably contacting the first rotator, configured to clean an outer circumferential surface of the first rotator;

a mover, connected to the abutment, configured to move the abutment with respect to the first rotator;

a controller, including:

a degradation estimator, operatively connected to the mover, configured to estimate a degradation level of the outer circumferential surface of the first rotator and control the mover to move the abutment with respect to the first rotator according to the degradation level of the first rotator; and a heat amount estimator, operatively connected to the degradation estimator, configured to estimate an amount of heat conducted to the recording medium conveyed through the fixing nip; and a cumulative number calculator, operatively connected to the degradation estimator, configured to calculate a cumulative number of recording media by multiplying a toner property coefficient determined based on an amount of an additive contained in toner of the toner image by a number of recording media conveyed through the fixing nip, wherein the cumulative number calculator is configured to calculate the cumulative number of recording media by multiplying an average in the toner property coefficient of the toner in a plurality of colors used to form the toner image by the number of recording media conveyed through the fixing nip and a weighting coefficient determined based on a number of colors of the toner, and wherein the degradation estimator is configured to estimate the degradation level of the first rotator based on the amount of heat estimated by the heat amount estimator.

19. A fixing device comprising:

a first rotator rotatable in a given direction of rotation;

a second rotator, contacting the first rotator, configured to form a fixing nip therebetween through which a recording medium bearing a toner image is conveyed;

a heater, opposite to at least one of the first rotator and the second rotator, configured to heat at least one of the first rotator and the second rotator;

an abutment, separably contacting the first rotator, configured to clean an outer circumferential surface of the first rotator;

a mover, connected to the abutment, configured to move the abutment with respect to the first rotator;

a controller, including:

a degradation estimator, operatively connected to the mover, configured to estimate a degradation level of the outer circumferential surface of the first rotator and control the mover to move the abutment with respect to the first rotator according to the degradation level of the first rotator; and a cumulative number calculator, operatively connected to the degradation estimator, configured to calculate a cumulative number of recording media by multiplying a toner property coefficient determined based on an amount of an additive contained in toner of the toner image by a number of recording media conveyed through the fixing nip, wherein the degradation estimator is configured to bring the abutment into contact with the first rotator when the cumulative number of recording media reaches a given value, and wherein the cumulative number calculator is configured to calculate the cumulative number of recording media by multiplying an average in the toner property coefficient of the toner in a plurality of colors used to form the toner image by the number of recording media conveyed through the fixing nip and a weighting coefficient determined based on a number of colors of the toner.

* * * * *